US007762357B2

(12) United States Patent
deBoer

(10) Patent No.: US 7,762,357 B2
(45) **Date of Patent: *Jul. 27, 2010**

(54) DUAL GRADIENT DRILLING METHOD AND APPARATUS WITH AN ADJUSTABLE CENTRIFUGE

(75) Inventor: Luc deBoer, Houston, TX (US)

(73) Assignee: Dual Gradient Systems, LLC, Richmond, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/196,573

(22) Filed: Aug. 22, 2008

(65) Prior Publication Data

US 2008/0302569 A1 Dec. 11, 2008

Related U.S. Application Data

(60) Division of application No. 11/284,334, filed on Nov. 21, 2005, which is a continuation-in-part of application No. 10/462,209, filed on Jun. 13, 2003, now Pat. No. 6,966,392, which is a continuation-in-part of application No. 10/390,528, filed on Mar. 17, 2003, now Pat. No. 6,926,101, which is a continuation-in-part of application No. 10/289,505, filed on Nov. 6, 2002, now Pat. No. 6,843,331, which is a continuation-in-part of application No. 09/784,367, filed on Feb. 15, 2001, now Pat. No. 6,536,540.

(51) Int. Cl.
*E21B 21/06* (2006.01)
*C09K 8/02* (2006.01)

(52) U.S. Cl. ..... 175/66; 175/65; 175/206; 175/207

(58) Field of Classification Search ..... 175/65, 175/66
See application file for complete search history.

(56) References Cited

U.S. PATENT DOCUMENTS 3,603,409 A 9/1971 Watkins (Continued)

OTHER PUBLICATIONS

IADC/SPE 1996 Drilling Conference Abstract Reporting Form/ 1 Page.

(Continued)

*Primary Examiner*—Zakiya W Bates
*Assistant Examiner*—Angela M DiTrani
(74) *Attorney, Agent, or Firm*—Haynes and Boone, LLP

(57) ABSTRACT

A system for controlling drilling mud density in drilling operations that combines a base fluid of lesser/greater density than the drilling fluid required at the drill bit to drill the borehole to produce a combination return mud in a riser. Concentric tubular members are disclosed, wherein one tubular member, such as the drill string, is utilized to inject the drilling fluid into the wellbore. Another tubular member carries the combination fluid to the surface for separation by a centrifuge system. By combining appropriate quantities of drilling mud with another fluid, the density of the combination fluid carrying drill cuttings to the surface can be regulated. During separation by the centrifuge, a weir plate having an adjustable height is utilized in the centrifuge to regulate the separation of the base fluid from the drilling fluid, producing a high density fluid and a low density fluid. The adjustable centrifuge permits the densities of the two fluids to be readily altered as desired for well drilling operations.

25 Claims, 15 Drawing Sheets

U.S. PATENT DOCUMENTS

| | | | | |
|---|---|---|---|---|
| 3,766,997 | A | 10/1973 | Heilhecker et al. | |
| 3,795,361 | A | 3/1974 | Lee | |
| 3,964,557 | A | 6/1976 | Juvkam-Wold | |
| 4,040,264 | A | 8/1977 | Neilon | |
| 4,099,583 | A | 7/1978 | Maus | |
| 4,245,777 | A | 1/1981 | Lavanchy | |
| 4,291,772 | A | 9/1981 | Beynet | |
| 4,313,559 | A * | 2/1982 | Ostkamp et al. | 494/38 |
| 5,586,609 | A | 12/1996 | Schuh | |
| 5,873,420 | A | 2/1999 | Gearhart | |
| 6,036,870 | A | 3/2000 | Briant et al. | |
| 6,132,630 | A * | 10/2000 | Briant et al. | 210/774 |
| 6,152,246 | A | 11/2000 | King | |
| 6,179,071 | B1 | 1/2001 | Dietzen | |
| 6,230,824 | B1 | 5/2001 | Peterman et al. | |
| 6,273,193 | B1 | 8/2001 | Hermann et al. | |
| 6,415,877 | B1 | 7/2002 | Fincher et al. | |
| 6,450,262 | B1 | 9/2002 | Regan | |
| 6,802,379 | B2 * | 10/2004 | Dawson et al. | 175/38 |
| 6,926,101 | B2 * | 8/2005 | deBoer | 175/70 |
| 6,966,392 | B2 * | 11/2005 | deBoer | 175/70 |
| 7,270,185 | B2 | 9/2007 | Fontana et al. | |
| 7,306,057 | B2 * | 12/2007 | Strong et al. | 175/66 |

OTHER PUBLICATIONS

Casing-while Drilling: The Next Step Change in Well Construction, World Oil, Oct. 1999.

* cited by examiner

Wells in 6,000ft WD
13-3/8" Casing Drilling

DUAL GRADIENT DRILLING METHOD AND APPARATUS WITH AN ADJUSTABLE CENTRIFUGE

CROSS-REFERENCE TO RELATED APPLICATIONS

The present application is a divisional patent application of U.S. patent application Ser. No. 11/284,334 filed on Nov. 21, 2005, which is a continuation-in-part of Ser. No. 10/462,209, filed Jun. 13, 2003, U.S. Pat. No. 6,966,392 issued on Nov. 22, 2005, which is a continuation-in-part of U.S. patent application Ser. No. 10/390,528 filed on Mar. 17, 2003, now U.S. Pat. No. 6,926,101 which is a continuation-in-part of U.S. patent application Ser. No. 10/289,505 filed on Nov. 6, 2002, now U.S. Pat. No. 6,843,331, which is a continuation-in-part of U.S. patent application Ser. No. 09/784,367 filed on Feb. 15, 2001, now U.S. Pat. No. 6,536,540, all of which are hereby incorporated by reference.

BACKGROUND OF THE INVENTION

1. Field of the Invention

The subject invention is generally related to systems for delivering drilling fluid (or "drilling mud") for oil and gas drilling applications and is specifically directed to a method and apparatus for varying the density of drilling mud in deep water oil and gas drilling applications.

2. Description of the Prior Art

It is well known to use drilling mud to provide hydraulic horse power for operating drill bits, to maintain hydrostatic pressure, to cool the drill bit during drilling operations, and to carry away particulate matter when drilling for oil and gas in subterranean wells. In conventional drilling operations, a well is drilled using a drill bit mounted on the end of a drill stem inserted down the drill pipe. The drilling mud is pumped down the drill pipe to provide the hydraulic horsepower necessary to operate the drill bit. A gas flow and/or other additives also may be pumped into the drill pipe to control the density of the mud. The mud passes through the drill bit and flows upwardly along the periphery of the drill string inside the open hole and casing, carrying particles loosened by the drill bit to the surface. At the surface, the return mud is cleaned to remove the particles and then is recycled down into the hole. In basic operations, drilling mud is pumped down the drill pipe to provide the hydraulic horsepower necessary to operate the drill bit, and then it flows back up from the drill bit along the periphery of the drill pipe and inside the open borehole and casing. The returning mud carries the particles loosed by the drill bit (i.e., "drill cuttings") to the surface. At the surface, the return mud is cleaned to remove the particles and then is recycled down into the hole.

In other non-conventional drilling operations, such as drilling with casing operations, the hole is drilled not with a typical drill bit, but rather with a bottom hole assembly which is run on a drill string through the casing to facilitate drilling of the borehole. Alternatively, a drillable bottom hole assembly may be mounted to the bottom of the casing and the entire casing may be rotated at the surface to facilitate drilling of the borehole. The advantage of drilling with casing is that the well can be drilled, cased, and cemented during one downhole trip, as opposed to drilling the borehole, retrieving the drill bit, and then running and cementing the casing downhole. Examples of drilling with casing systems includes Tesco Corporation's Casing Drilling™ system and Weatherford's Drillshoe™ system.

In both conventional and non-conventional drilling application, a mud management system must be employed to monitor and control the density of the drilling mud in order to maximize the efficiency of the drilling operation and to maintain the hydrostatic pressure. One example of such a system is shown and described in U.S. Pat. No. 5,873,420, entitled: "Air and Mud Control System for Underbalanced Drilling", issued on Feb. 23, 1999 to Marvin Gearhart. The system shown and described in the Gearhart patent provides for a gas flow in the tubing for mixing the gas with the mud in a desired ratio so that the mud density is reduced to permit enhanced drilling rates by maintaining the well in an underbalanced condition.

It is known that there is a preexistent pressure on the formations of the earth, which, in general, increases as a function of depth due to the weight of the overburden on particular strata. This weight increases with depth so the prevailing or quiescent bottom hole pressure is increased in a generally linear curve with respect to depth. As the well depth is doubled in a normal-pressured formation, the pressure is likewise doubled. This is further complicated when drilling in deep water or ultra deep water because of the pressure on the sea floor by the water above it. Thus, high pressure conditions exist at the beginning of the hole and increase as the well is drilled. It is important to maintain a balance between the mud density and pressure and the hole pressure. Otherwise, the pressure in the hole will force material back into the wellbore and cause what is commonly known as a "kick." In basic terms, a kick occurs when the gases or fluids in the wellbore flow out of the formation into the wellbore and bubble upward. When the standing column of drilling fluid is equal to or greater than the pressure at the depth of the borehole, the conditions leading to a kick are minimized. When the mud density is insufficient, the gases or fluids in the borehole can cause the mud to decrease in density and become so light that a kick occurs.

Kicks are a threat to drilling operations and a significant risk to both drilling personnel and the environment. Typically blowout preventers (or "BOP's") are installed at the ocean floor or at the surface to contain the wellbore and to prevent a kick from becoming a "blowout" where the gases or fluids in the wellbore overcome the BOP and flow upward creating an out-of-balance well condition. However, the primary method for minimizing the risk of a blowout condition is the proper balancing of the drilling mud density to maintain the well in a balanced condition at all times. While BOP's can contain a kick and prevent a blowout from occurring thereby minimizing the damage to personnel and the environment, the well is usually lost once a kick occurs, even if contained. It is far more efficient and desirable to use proper mud control techniques in order to reduce the risk of a kick than it is to contain a kick once it occurs.

In order to maintain a safe margin, the column of drilling mud in the annular space around the drill stem is of sufficient weight and density to produce a high enough pressure to limit risk to near-zero in normal drilling conditions. While this is desirable, it unfortunately slows down the drilling process. In some cases underbalanced drilling has been attempted in order to increase the drilling rate. However, to the present day, the mud density is the main component for maintaining a pressurized well under control.

Deep water and ultra deep water drilling has its own set of problems coupled with the need to provide a high density drilling mud in a wellbore that starts several thousand feet below sea level. The pressure at the beginning of the hole is equal to the hydrostatic pressure of the seawater above it, but the mud must travel from the sea surface to the sea floor before its density is useful. It is well recognized that it would be desirable to maintain mud density at or near seawater density (or 8.6 PPG) when above the borehole and at a heavier density from the seabed down into the well. In the past, pumps have been employed near the seabed for pumping out the returning mud and cuttings from the seabed above the BOP's and to the surface using a return line that is separate from the riser. This system is expensive to install, as it requires separate lines, expensive to maintain, and very expensive to run. Another experimental method employs the injection of low density particles—such—as glass beads into the returning fluid in the riser above the sea floor to reduce the density of the returning mud as it is brought to the surface. Typically, the BOP stack is on the sea floor and the glass beads are injected above the BOP stack.

While it has been proven desirable to reduce drilling mud density at a location near and below the seabed in a wellbore, there are no prior art techniques that effectively accomplish this objective.

SUMMARY OF THE INVENTION

The present invention is directed at a method and apparatus for controlling drilling mud density in deep water or ultra deep water drilling applications using conventional and/or non-conventional (e.g., drilling with casing) systems.

It is an important aspect of the present invention that the drilling mud is diluted using a base fluid. The base fluid is of lesser density than the drilling mud required at the wellhead. The base fluid and drilling mud are combined to yield a diluted mud.

In a preferred embodiment of the present invention, the base fluid has a density less than seawater (or less than 8.6 PPG). By combining the appropriate quantities of drilling mud with base fluid, a riser mud density at or near the density of seawater may be achieved. It can be assumed that the base fluid is an oil base having a density of approximately 6.5 PPG. Using an oil base mud system, for example, the mud may be pumped from the surface through the drill string and into the bottom of the well bore at a density of 12.5 PPG, typically at a rate of around 800 gallons per minute. The fluid in the riser, which is at this same density, is then diluted above the sea floor or alternatively below the sea floor with an equal amount or more of base fluid through the riser charging lines. The base fluid is pumped at a faster rate, say 1500 gallons per minute, providing a return fluid with a density that can be calculated as follows:

$$[(F_{Mi}\times Mi)+(F_{Mb}\times Mb)]/(F_{Mi}+F_{Mb})=Mr,$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

$$Mr=((800\times 12.5)+(1500\times 6.5))/(800+1500)=8.6\text{ PPG}.$$

The flow rate, $F_r$, of the mud having the density Mr in the riser is the combined flow rate of the two flows, $F_i$, and $F_b$. In the example, this is:

$$F_r=F_i+F_b=800\text{ gpm}+1500\text{ gpm}=2300\text{ gpm}.$$

The return flow in the riser is a mud having a density of 8.6 PPG (or the same as seawater) flowing at 2300 gpm. This mud is returned to the surface and the cuttings are separated in the usual manner. Centrifuges at the surface will then be employed to separate the heavy mud, density Mi, from the light mud, density Mb.

It is an object and feature of the subject invention to provide a method and apparatus for diluting mud density in deep water and ultra deep water drilling applications for both drilling units and floating platform configurations using conventional and/or non-conventional (e.g., DWC) drilling systems.

It is another object and feature of the subject invention to provide a method for diluting the density of mud in a riser by injecting low density fluids into the riser lines (typically the charging line or booster line or possibly the choke or kill line) or riser systems with surface BOP's.

It is also an object and feature of the subject invention to provide a method of diluting the density of mud in a concentric riser system.

It is yet another object and feature of the subject invention to provide a method for diluting the density of mud in a riser by injecting low density fluids into the riser charging lines or riser systems with a below-seabed wellhead injection apparatus.

It is a further object and feature of the subject invention to provide an apparatus for separating the low density and high density fluids from one another at the surface.

Other objects and features of the invention will be readily apparent from the accompanying drawing and detailed description of the preferred embodiment.

DESCRIPTION OF A PREFERRED EMBODIMENT OF THE PRESENT INVENTION

Figure 1:
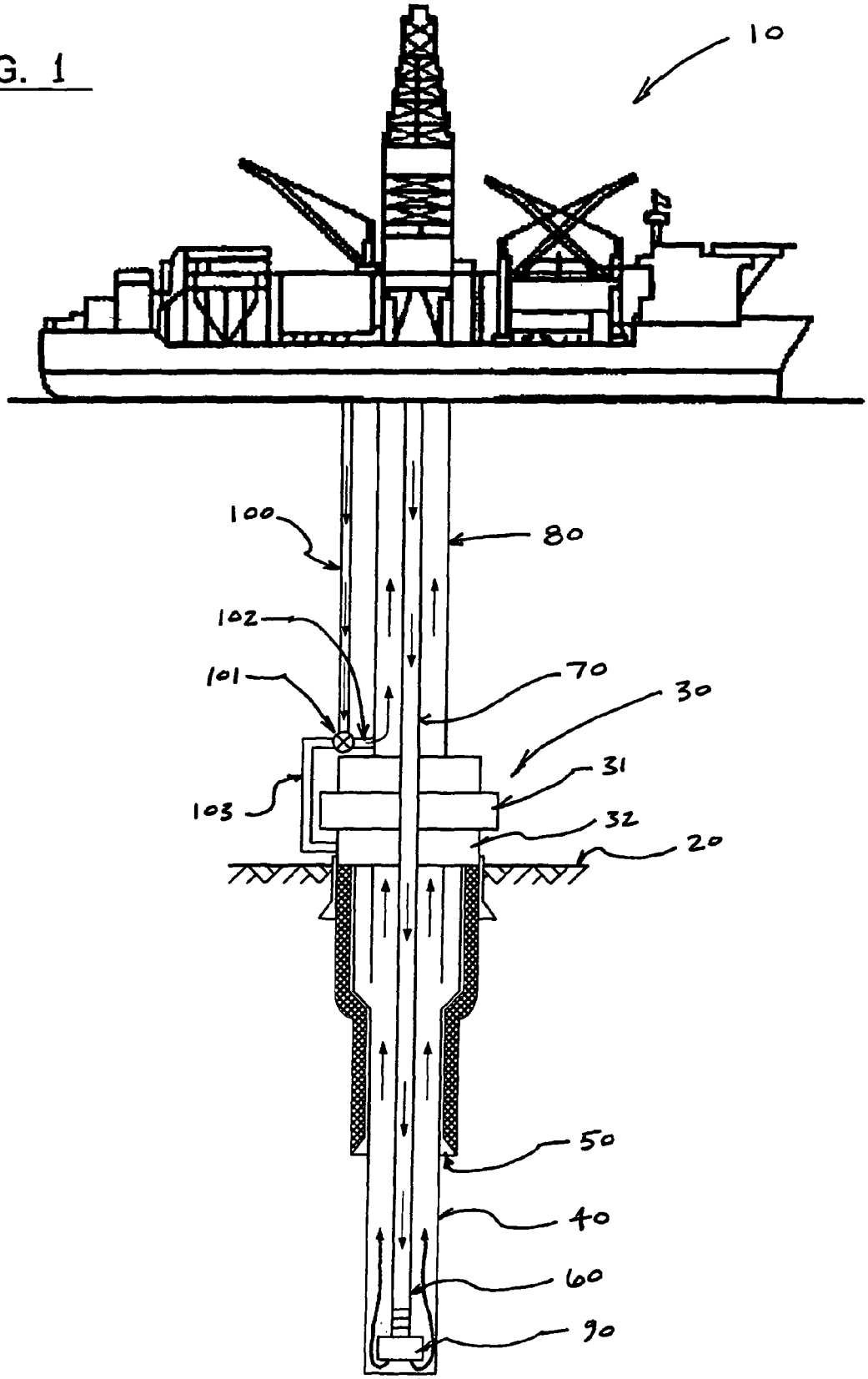
FIG. 1 is a schematic of a typical offshore drilling system modified to accommodate the teachings of the present invention depicting drilling mud being diluted with a base fluid at or above the seabed.

A description of certain embodiments of the mud recirculation system of the present invention is provided to facilitate an understanding of the invention. This description is intended to be illustrative and not limiting of the present invention. These and other objects, features, and advantages of the present invention will become apparent after a review of the entire detailed description, the disclosed embodiments, and the appended claims. As will be appreciated by one of ordinary skill in the art, many other beneficial results and applications can be appreciated by applying modifications to the invention as disclosed. Such modifications are within the scope of the claims appended hereto.

Moreover, while the mud recirculation system of the present invention is described with respect to casing installation operations, it is intended that the present invention may be used to install any tubular good used in both conventional and non-conventional well drilling operations including, but not limited to, casings, subsea casings, surface casings, conductor casings, intermediate liners, intermediate casings, production casings, production liners, casing liners, and/or risers. Furthermore, while the dual gradient mud recirculation system of the present invention is described with respect to drilling vertical wells, the benefits of the dual gradient mud system may be also be achieved in extended reach and horizontal well drilling operations.

With respect to FIGS. 1-4, a mud recirculation system for use in conventional offshore drilling operations to pump drilling mud: (1) downward through a drill string to operate a drill bit thereby producing drill cuttings, (2) outward into the annular space between the drill string and the formation of the wellbore where the mud mixes with the cuttings, and (3) upward from the wellbore to the surface via a riser in accordance with the present invention is shown. A platform 10 is provided from which drilling operations are performed. The platform 10 may be an anchored floating platform or a drill ship or a semi-submersible drilling unit. A series of concentric strings runs from the platform 10 to the sea floor or seabed 20 and into a stack 30. The stack 30 is positioned above a wellbore 40 and includes a series of control components, generally including one or more blowout preventers or BOP's 31. The concentric strings include casing 50, tubing 60, a drill string 70, and a riser 80. A drill bit 90 is mounted on the end of the drill string 70. A riser charging line (or booster line) 100 runs from the surface to a switch valve 101. The riser charging line 100 includes an above-seabed section 102 running from the switch valve 101 to the riser 80 and a below-seabed section 103 running from the switch valve 101 to a wellhead injection apparatus 32. The above-seabed charging line section 102 is used to insert a base fluid into the riser 80 to mix with the upwardly returning drilling mud at a location at or above the seabed 20. The below-seabed charging line section 103 is used to insert a base fluid into the wellbore to mix with the upwardly returning drilling mud via a wellhead injection apparatus 32 at a location below the seabed 20. The switch valve 101 is manipulated by a control unit to direct the flow of the base fluid into either the above-seabed charging line section 102 or the below-seabed charging line section 103. While this embodiment of the present invention is described with respect to an offshore drilling rig platform, it is intended that the mud recirculation system of the present invention can also be employed for land-based drilling operations.

Figure 5:
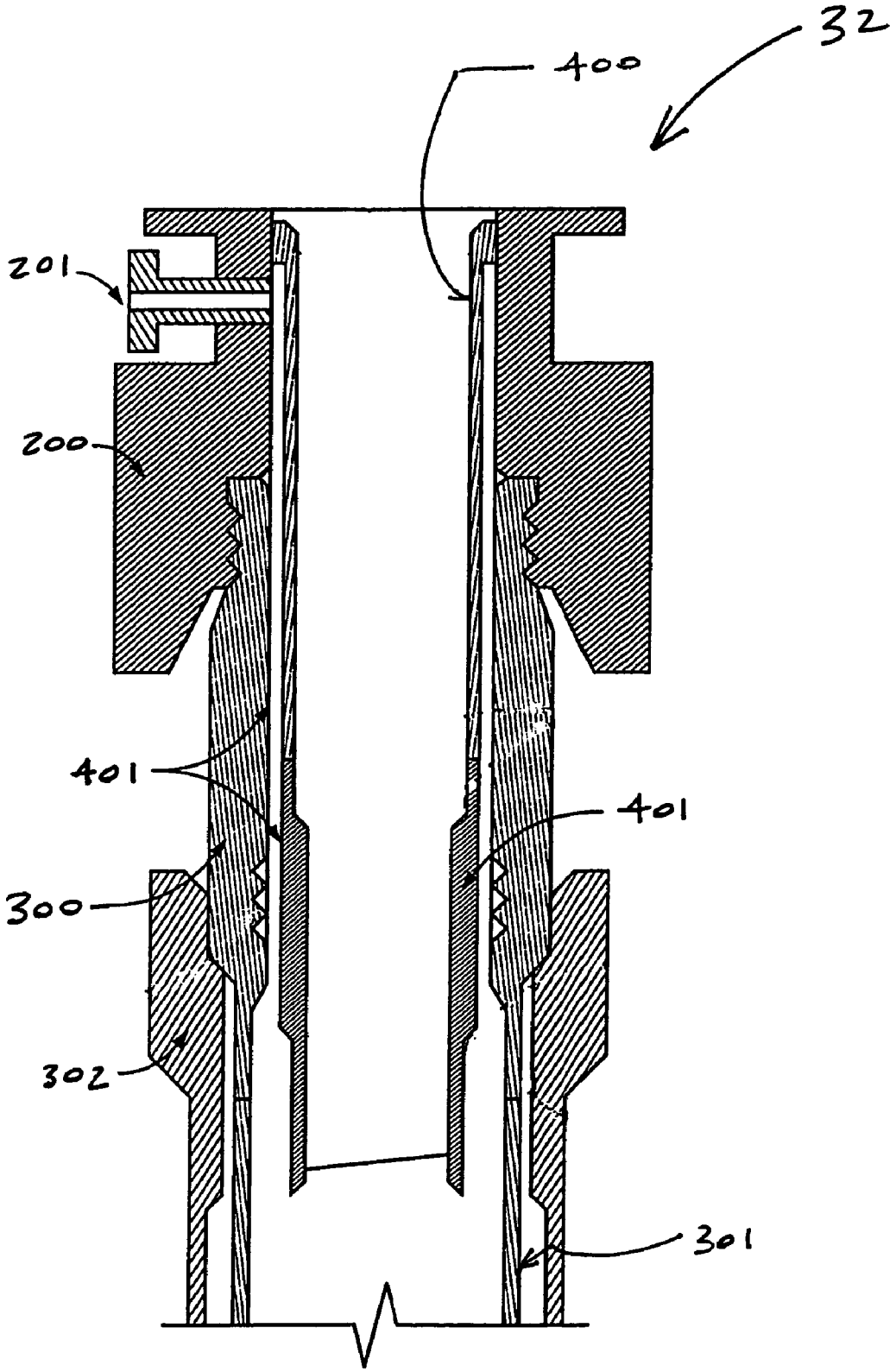
FIG. 5 is an enlarged sectional view of a below-seabed wellhead injection apparatus in accordance with the present invention for injecting a base fluid into drilling mud below the seabed.

With respect to FIG. 5, the wellhead injection apparatus 32 for injecting a base fluid into the drilling mud at a location below the seabed is shown. The injection apparatus 32 includes: (1) a wellhead connector 200 for connection with a wellhead 300 and having an axial bore therethrough and an inlet port 201 for providing communication between the riser charging line 100 (FIG. 3) and the wellbore; and (2) an annulus injection sleeve 400 having a diameter less than the diameter of the axial bore of the wellhead connector 200 attached to the wellhead connector thereby creating an annulus injection channel 401 through which the base fluid is pumped downward. The wellhead 300 is supported by a wellhead body 302 which is cemented in place to the seabed.

In a preferred embodiment of the present invention, the wellhead housing 302 is a 36 inch diameter casing and the wellhead 300 is attached to the top of a 20 inch diameter casing. The annulus injection sleeve 400 is attached to the top of a 13⅜ inch to 16 inch diameter casing sleeve having a 2,000 foot length. Thus, in this embodiment of the present invention, the base fluid is injected into the wellbore at a location approximately 2,000 feet below the seabed. While the preferred embodiment is described with casings and casing sleeves of a particular diameter and length, it is intended that the size and length of the casings and casing sleeves can vary depending on the particular drilling application.

In a conventional drilling operation, with respect to FIGS. 1-5, drilling mud is pumped downward from the platform 10 into the drill string 70 to turn the drill bit 90 via the tubing 60. As the drilling mud flows out of the tubing 60 and past the drill bit 90, it flows into the annulus defined by the outer wall of the tubing 60 and the formation 40 of the wellbore. The mud picks up the cuttings or particles loosened by the drill bit 90 and carries them to the surface via the riser 80. A riser charging line 100 is provided for charging (i.e., circulating) the fluid in the riser 80 in the event a pressure differential develops that could impair the safety of the well.

Figure 2:
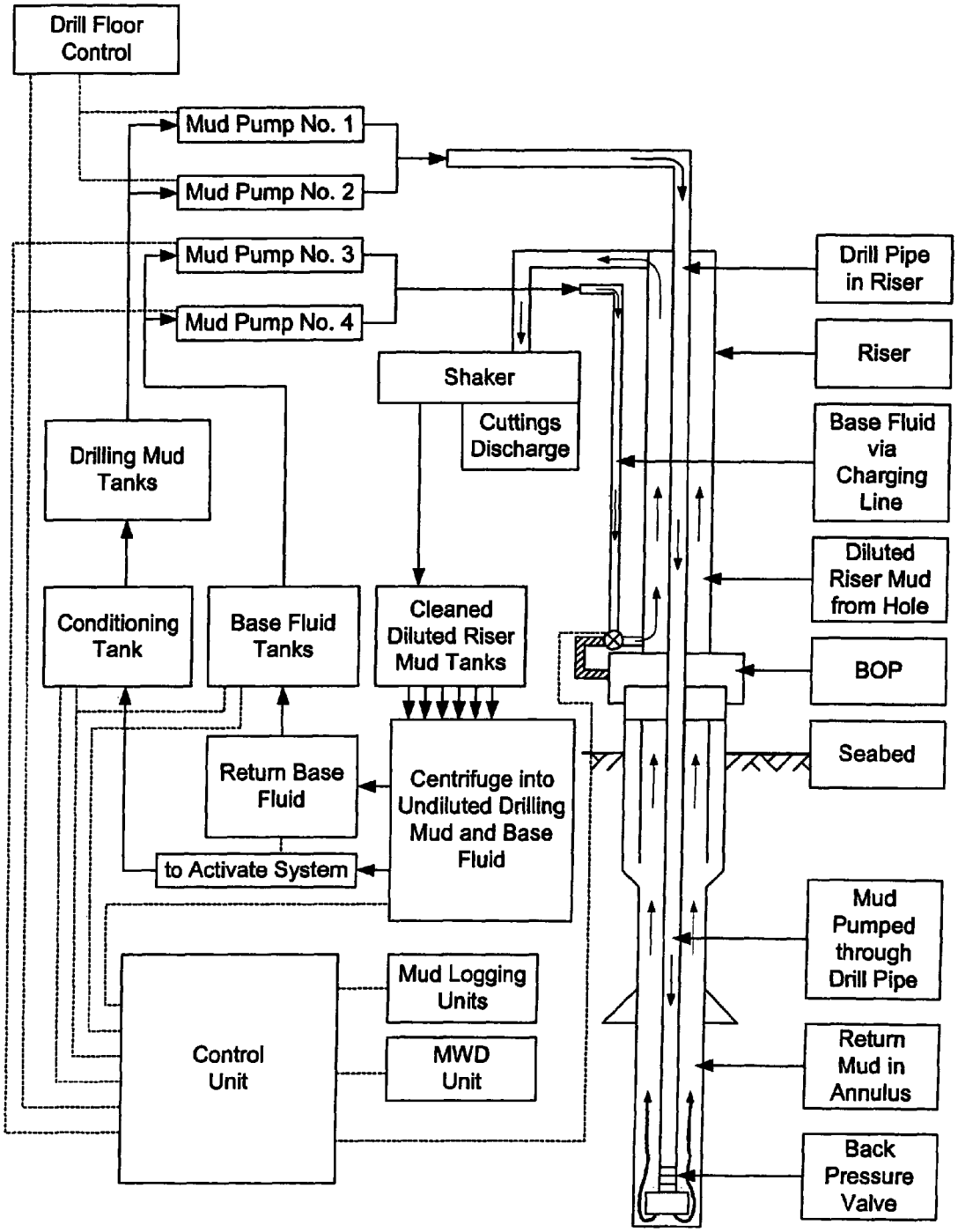
FIG. 2 is a diagram of the drilling mud circulating system in accordance with the present invention for diluting drilling mud at or above the seabed.
Figure 3:
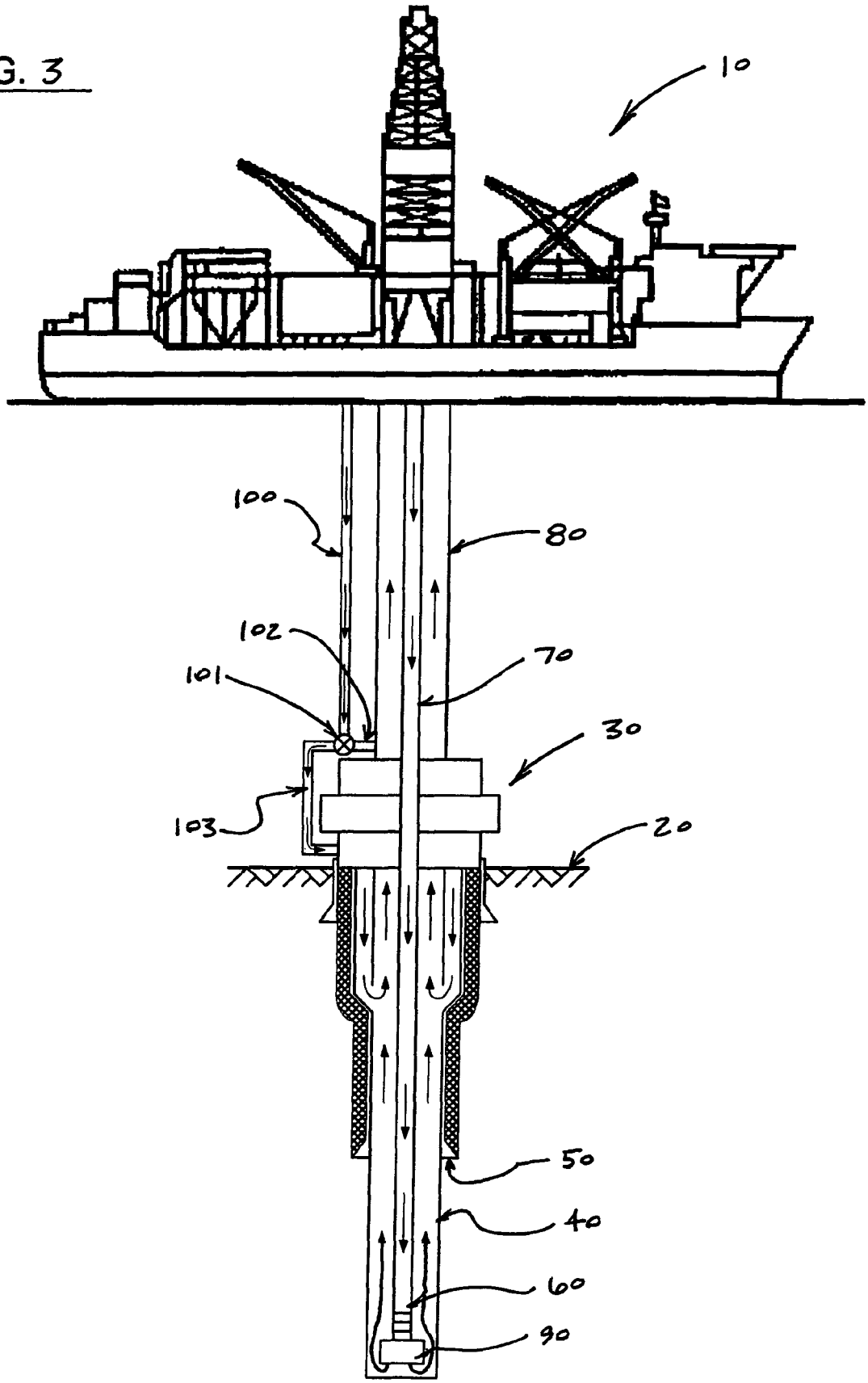
FIG. 3 is a schematic of a typical offshore drilling system modified to accommodate the teachings of the present invention depicting drilling mud being diluted with a base fluid below the seabed.
Figure 4:
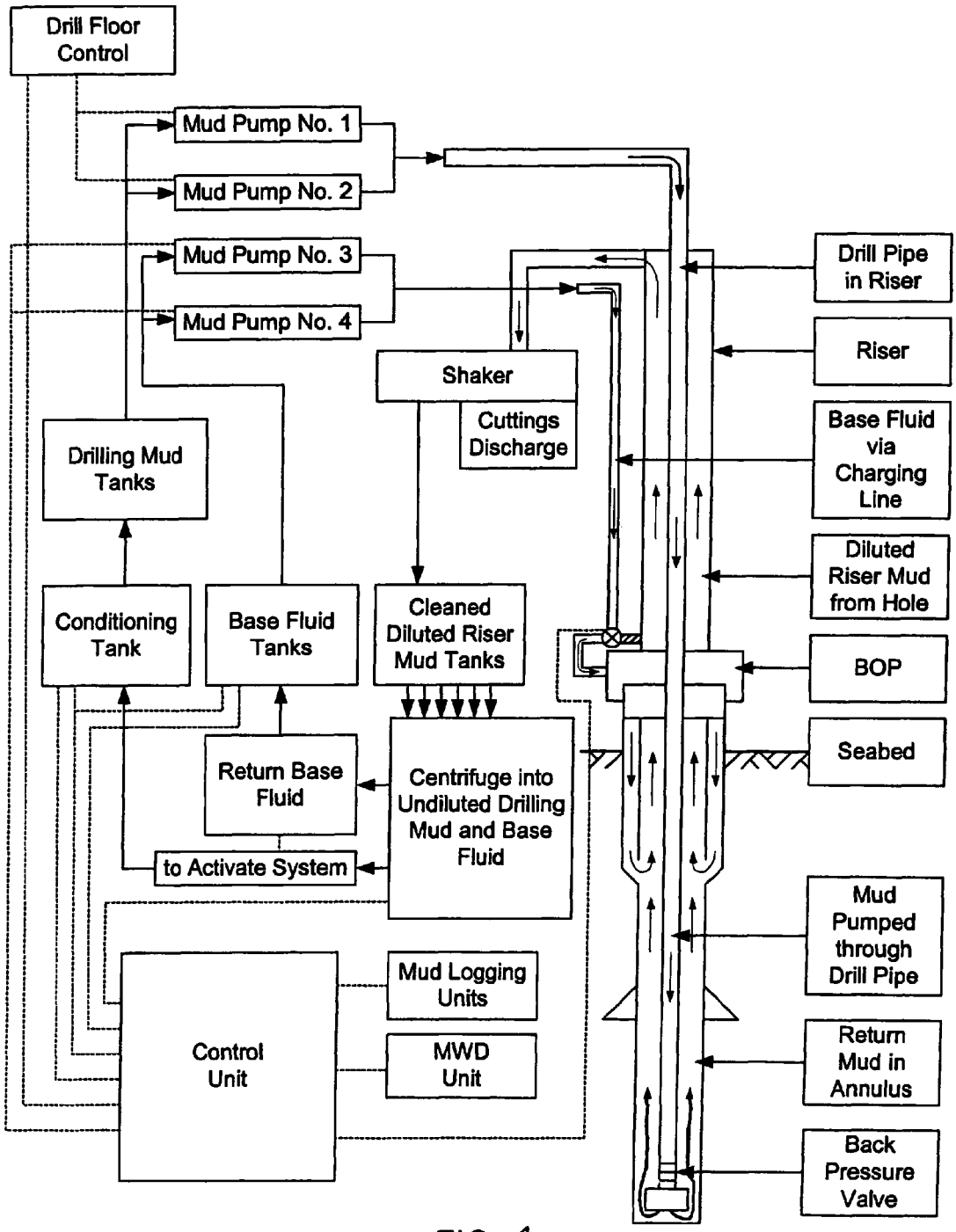
FIG. 4 is a diagram of the drilling mud circulating system in accordance with the present invention for diluting drilling mud below the seabed.

In accordance with a preferred embodiment of the present invention, when it is desired to dilute the rising drilling mud, a base fluid (typically, a light base fluid) is mixed with the drilling mud either at (or immediately above) the seabed or below the seabed. A reservoir contains a base fluid of lower density than the drilling mud and a set of pumps connected to the riser charging line (or booster charging line). This base fluid is of a low enough density that when the proper ratio is mixed with the drilling mud a combined density equal to or close to that of seawater can be achieved. When it is desired to dilute the drilling mud with base fluid at a location at or immediately above the seabed 20, the switch valve 101 is manipulated by a control unit to direct the flow of the base fluid from the platform 10 to the riser 80 via the charging line 100 and above-seabed section 102 (FIGS. 1-2). Alternatively, when it is desired to dilute the drilling mud with base fluid at a location below the seabed 20, the switch valve 101 is manipulated by a control unit to direct the flow of the base fluid from the platform 10 to the riser 80 via the charging line 100 and below-seabed section 103 (FIGS. 3-4).

Another embodiment of the present invention includes a mud recirculation system for use with offshore drilling with casing ("DWC") operations. With respect to FIGS. 9-10, this embodiment of the mud recirculation system is for use in pumping drilling mud: (1) downward through a drill string and/or casing to operate a bottom hole drilling assembly to facilitate DWC operations thereby producing drill cuttings, (2) outward into the annular space between the drill string and/or casing and the formation of the wellbore where the mud mixes with the cuttings, and (3) upward from the wellbore to the surface via a riser.

As with conventional drilling operations, DWC operations are performed from a platform 10 which may be an anchored floating platform or a drill ship or a semi-submersible drilling unit. A marine/drilling riser 80 runs from the DWC platform 10 to the sea floor or seabed 20 and into a stack 30. The stack 30 is positioned above a wellbore 40 and includes a series of control components, generally including one or more blowout preventers or BOP's 31.

In one embodiment of the mud recirculation system for use with DWC operations, a casing 450 having a rotating casing head and hanger running tool 451 and reaming shoe 454 is used to drill a hole section 40 such that the casing may be hung from surface casing 50. A bottom hole assembly ("BHA") 452 is mounted on the end of a drill string 70 and tubing 60 for running through the casing 450 and drilling the wellbore with drill bit 90 and under reamer 453. The drill string 70 includes a set of ports 455 for diverting a selected fraction of drilling fluid into the annulus between the casing 450 and the tubing 60. The casing 450 is rotated by the top drive on the drilling platform 10 thereby reaming out the hole cut by the BHA 452 such that the casing follows behind the BHA as the wellbore is drilled. Alternatively, a steerable BHA may be used to control the direction of drilling operations.

In another embodiment of the mud recirculation system for use with DWC operations, a drillable BHA is mounted or latched to the bottom end of the casing and the wellbore is drilled by rotating the casing with the top drive. Once total depth is reached and the casing is cemented in place, the BHA is drilled out by a conventional drill bit or by a subsequent casing in the following string.

In still another embodiment of the mud recirculation system for use with DWC operations, no drill string or tubing is used to supply mud to drive the BHA. Rather, drilling mud is pumped to the bottom of the wellbore to operate the BHA, circulate drill cuttings, and/or cool the drill bit via the casing itself. Once total depth is reached, the BHA may be retrieved and returned to the surface by a guide wire or drilled out by a conventional drill bit or by a subsequent casing in the following string.

Figure 9:
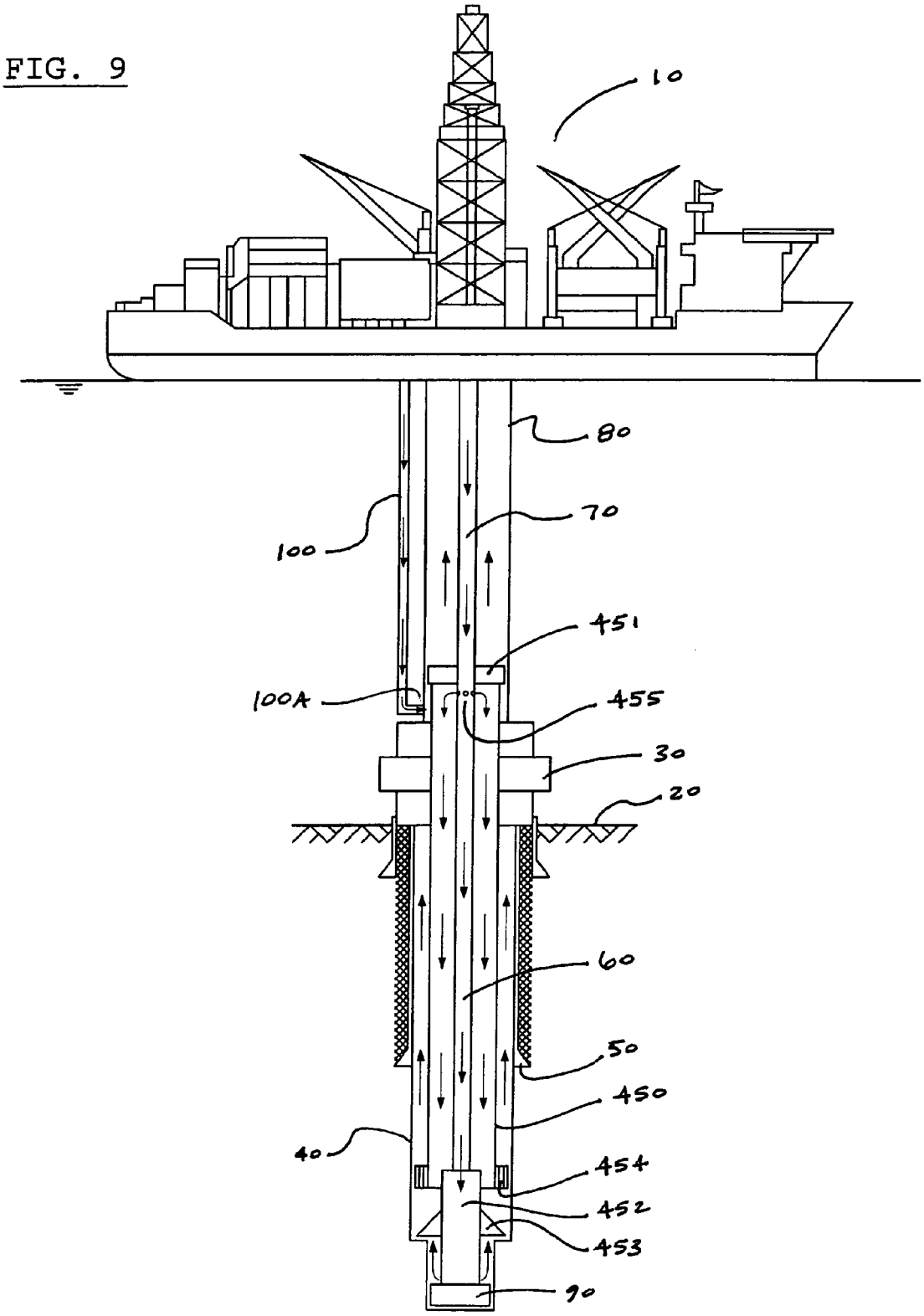
FIG. 9 is a schematic of an offshore drilling system employing drilling with casing techniques modified to accommodate the teachings of the present invention depicting drilling mud being diluted with a base fluid at or above the seabed.

With particular reference to FIG. 9, each embodiment of the mud recirculation system of the present invention for use with DWC operations includes a riser charging line (or booster line) 100 running from the surface to an insertion point 100A at or just above the seabed 20 (as shown in FIG. 9). The charging line 100 is used to insert a base fluid into the wellbore to mix with the upwardly returning drilling at a location at or just above the seabed 20.

Figure 10:
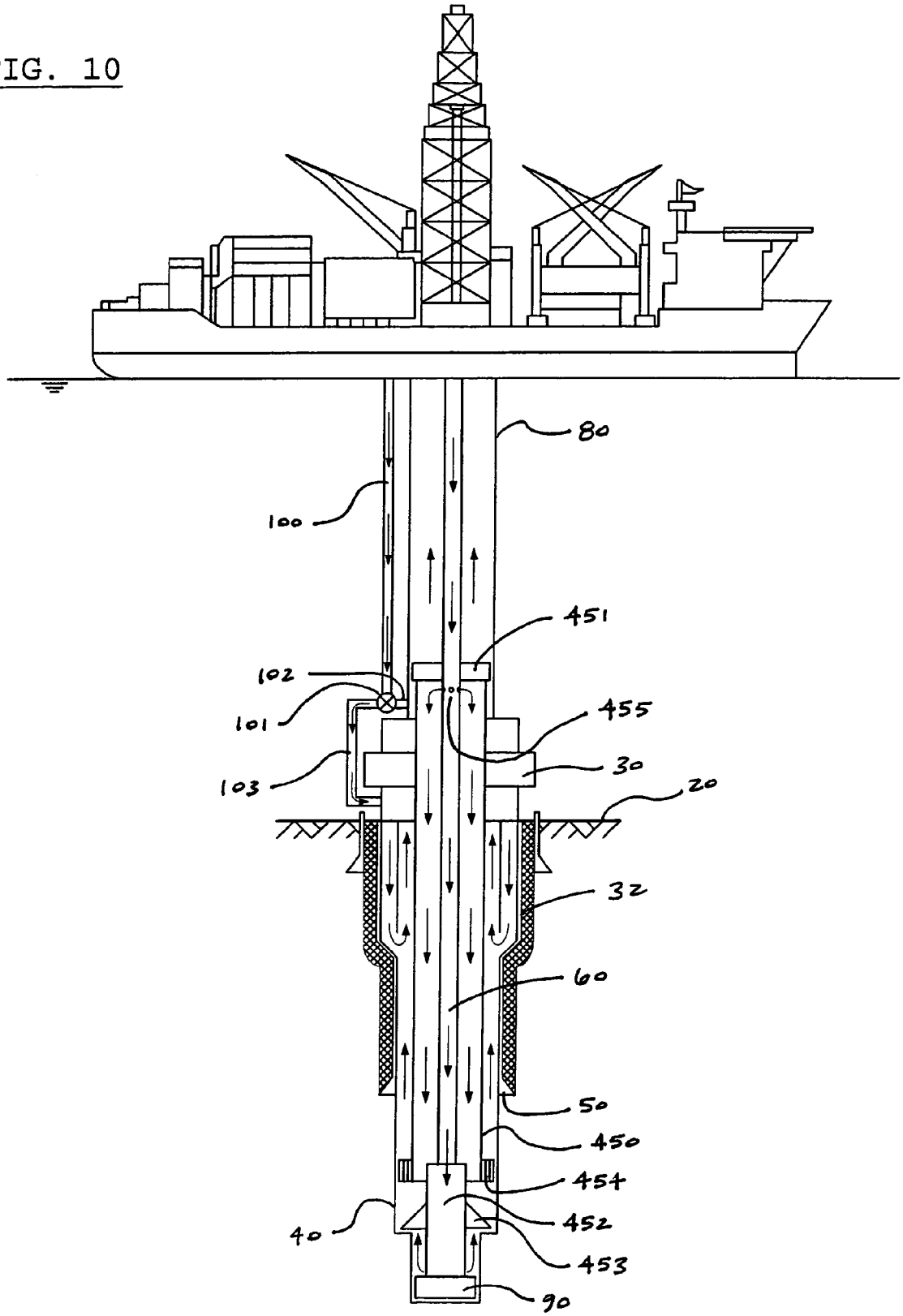
FIG. 10 is a schematic of an offshore drilling system employing drilling with casing techniques modified to accommodate the teachings of the present invention depicting drilling mud being diluted with a base fluid below the seabed.

Alternatively, with particular reference to FIG. 10, another embodiment of the mud recirculation system of the present invention for use with DWC operations includes a riser charging line (or booster line) 100 running from the surface to a switch valve 101. The riser charging line 100 includes an above-seabed section 102 running from the switch valve 101 to the riser 80 and a below-seabed section 103 running from the switch valve 101 to a wellhead injection apparatus 32. The above-seabed charging line section 102 is used to insert a base fluid into the riser 80 to mix with the upwardly returning drilling mud at a location at or above the seabed 20. The below-seabed charging line section 103 is used to insert a base fluid into the wellbore to mix with the upwardly returning drilling mud via a wellhead injection apparatus 32 at a location below the seabed 20. The switch valve 101 is manipulated by a control unit to direct the flow of the base fluid into either the above-seabed charging line section 102 or the below-seabed charging line section 103. The wellhead injection apparatus 32 for injecting a base fluid into the drilling mud at a location below the seabed is identical to that described above with respect to convention drilling operations and as shown in FIG. 5. Moreover, the embodiments of the mud recirculation systems for use with DWC drilling operations as described herein may be employed for land-based drilling operations.

While the aforementioned embodiments of the present invention each include a mud recirculation system for use with injecting a base fluid into the return mud stream via a charging line, it is intended that the mud recirculation system of the present invention may alternatively employ concentric riser technology to deliver the base fluid to the return mud stream. In such an arrangement, the BOP can be located either: (1) at the surface such that the concentric riser runs from the BOP to the wellhead at the seabed, or (2) at the seabed such that the concentric riser runs from the drilling platform at the surface to the BOP. Concentric riser technology is generally used today to facilitate oil or gas production once drilling and casing operations are complete. The concentric riser itself includes an inner pipe for transporting produced oil or gas from the formation to the surface, and an outer pipe which defines an annulus between the inner and outer pipes for circulating nitrogen gas around the production riser. This is generally done to thermally insulate the production riser in deepwater wells where the seabed temperature often approaches 0° C. This same concentric riser technology can be used to facilitate dual gradient drilling operations using the inner pipe for transporting the return mud stream (and drill cuttings) from the wellbore to the surface, and the annulus between the inner and outer pipes for transporting a base fluid downward to be inserted into the return mud stream either at a location near the seabed or beneath the seabed. It is further intended that this concentric riser arrangement can be used to facilitate dual gradient drilling in both conventional drill bit drilling and DWC applications.

With respect to FIGS. 9-10, in DWC drilling operations, drilling mud is pumped downward from the platform 10 into the drill string 70 to drive the BHA 452 via the tubing 60. As the drilling mud flows out of the tubing 60 and past the drill bit 90 of the BHA 452, it flows into the annulus defined by the outer wall of the casing 450 and the formation 40 of the wellbore. The mud picks up the cuttings or particles loosened by the drill bit 90 and carries them to the surface via the riser 80. Since the casing 450 is larger in diameter than a typical drill pipe, the cross-sectional area of the annulus between the casing and the formation 40 is smaller than if a drill pipe were used. This smaller area provides a sufficiently high return mud rate while permitting the operator to supply the mud downhole at a decreased rate. Moreover, a riser charging line 100 is provided for charging (i.e., circulating) the fluid in the riser 80 in the event a pressure differential develops that could impair the safety of the well.

In accordance with a preferred embodiment of the present invention, when it is desired to dilute the rising drilling mud, a base fluid (typically, a light base fluid) is mixed with the drilling mud either at (or immediately above) the seabed or below the seabed. A reservoir contains a base fluid of lower density than the drilling mud and a set of pumps connected to the riser charging line (or booster charging line). This base fluid is of a low enough density that when the proper ratio is mixed with the drilling mud a combined density equal to or close to that of seawater can be achieved. When it is desired to dilute the drilling mud with base fluid at a location at or immediately above the seabed 20, the switch valve 101 is manipulated by a control unit to direct the flow of the base fluid from the platform 10 to the riser 80 via the charging line 100 and above-seabed section 102. Alternatively, when it is desired to dilute the drilling mud with base fluid at a location below the seabed 20, the switch valve 101 is manipulated by a control unit to direct the flow of the base fluid from the platform 10 to the riser 80 via the charging line 100 and below-seabed section 103.

In a typical example, for both conventional and DWC operations, the drilling mud is an oil based mud with a density of 12.5 PPG and the mud is pumped at a rate of 800 gallons per minute or "gpm". The base fluid is an oil base fluid with a density of 6.5 to 7.5 PPG and can be pumped into the riser charging lines at a rate of 1500 gpm. Using this example, a riser fluid having a density of 8.6 PPG is achieved as follows:

$$Mr=[(F_{Mi}\times Mi)+(F_{Mb}\times Mb)]/(F_{Mi}+F_{Mb}),$$

where:

$F_{Mi}$=flow rate $F_i$ of fluid, $F_{Mb}$=flow rate $F_b$ of base fluid into riser charging lines, Mi=mud density into well, Mb=mud density into riser charging lines, and Mr=mud density of return flow in riser.

In the above example:

Mi=12.5 PPG,

Mb=6.5 PPG, $F_{Mi}$=800 gpm, and $F_{Mb}$=1500 gpm.

Thus the density Mr of the return mud can be calculated as:

$$Mr=((800\times 12.5)+(1500\times 6.5))/(800+1500)=8.6\text{ PPG}.$$

The flow rate, $F_r$, of the mud having the density Mr in the riser is the combined flow rate of the two flows, $F_i$, and $F_b$. In the example, this is:

$$F_r=F_i+F_b=800\text{ gpm}+1500\text{ gpm}=2300\text{ gpm}.$$

The return flow in the riser above the base fluid injection point is a mud having a density of 8.6 PPG (or close to that of seawater) flowing at 2300 gpm.

Although the example above employs particular density values, it is intended that any combination of density values may be utilized using the same formula in accordance with the present invention.

Figure 6:
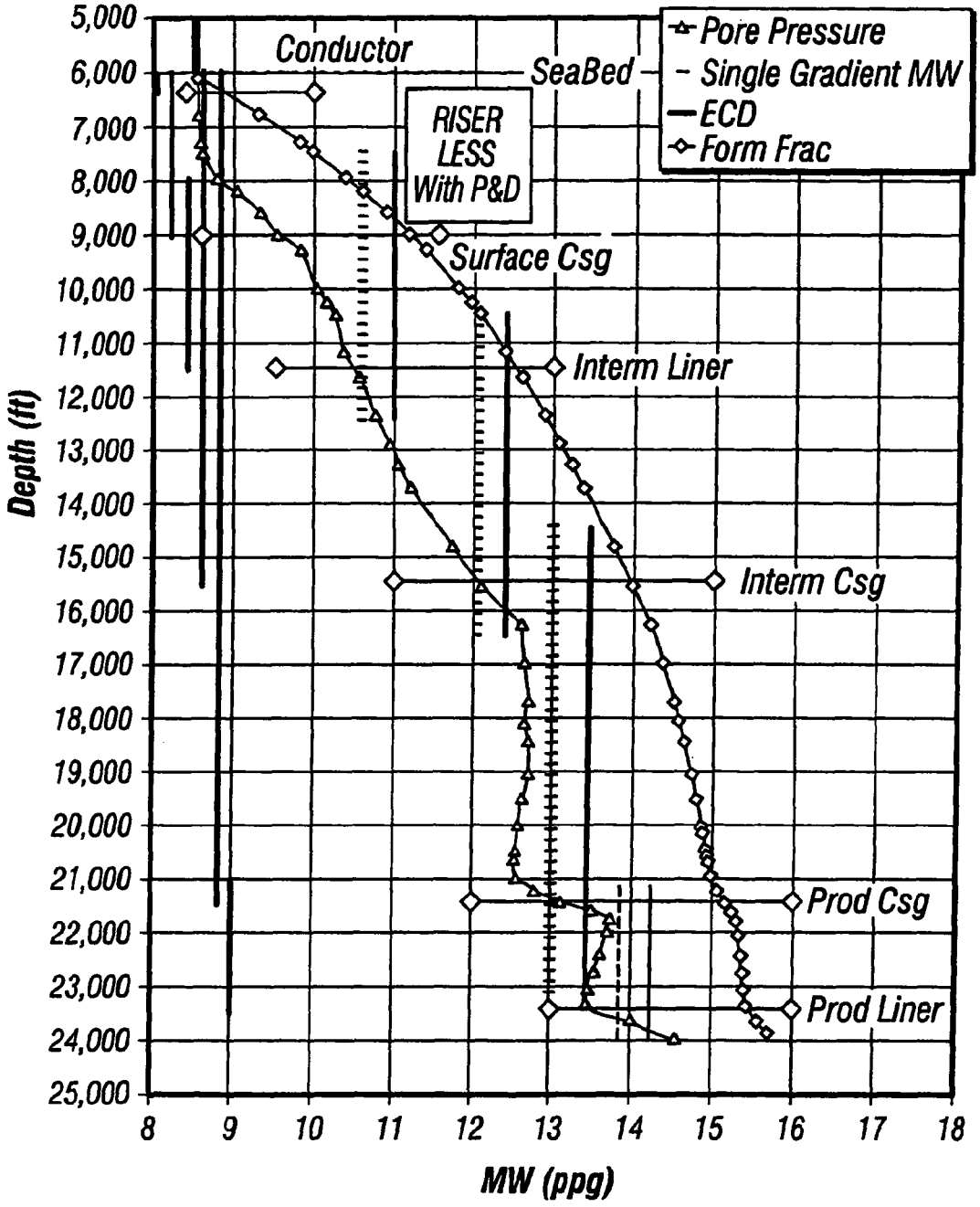
FIG. 6 is a graph showing depth versus down hole pressures in a single gradient drilling mud application.
Figure 7:
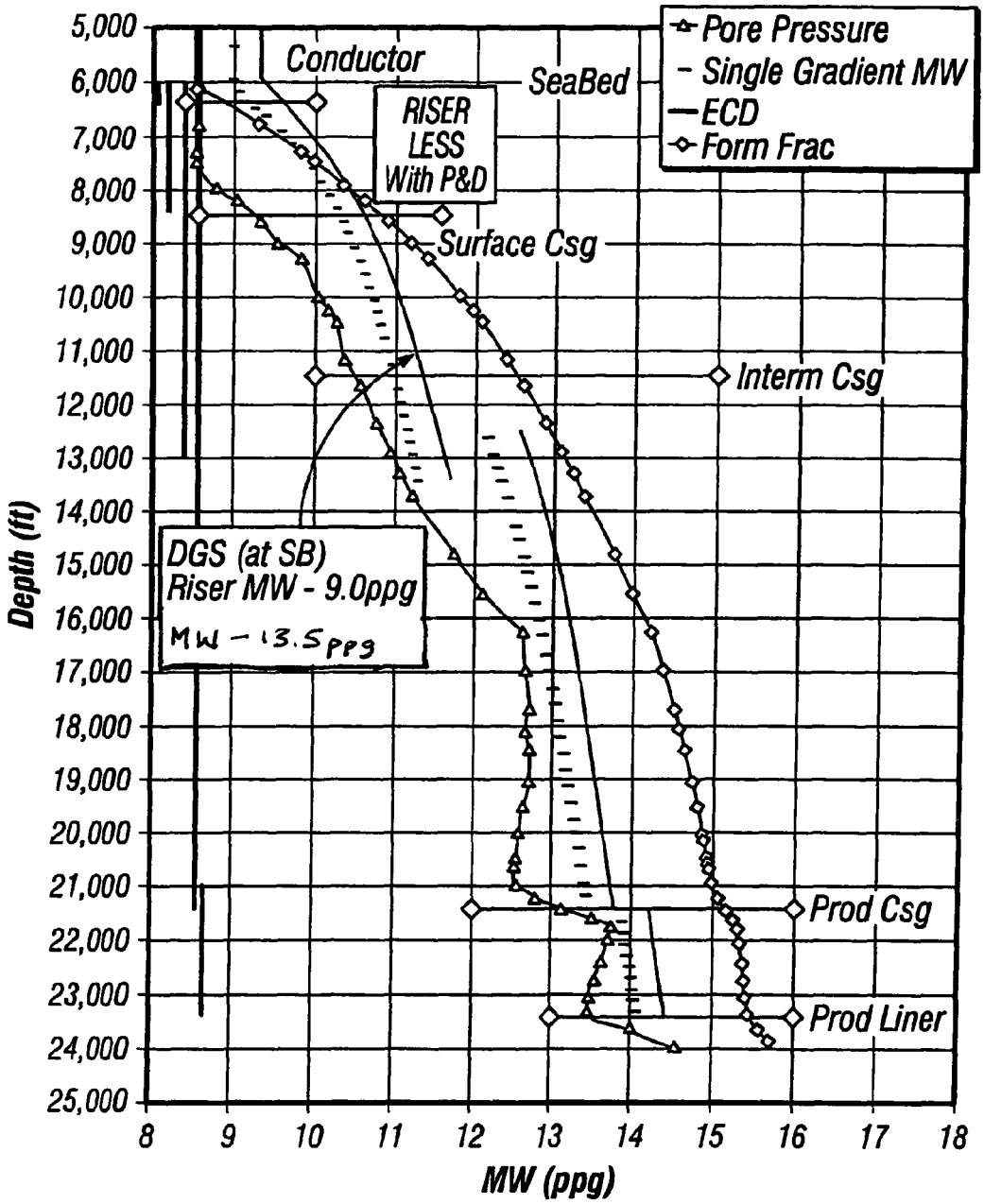
FIG. 7 is a graph showing depth versus down hole pressures and illustrates the advantages obtained using multiple density muds injected at the seabed versus a single gradient mud.
Figure 8:
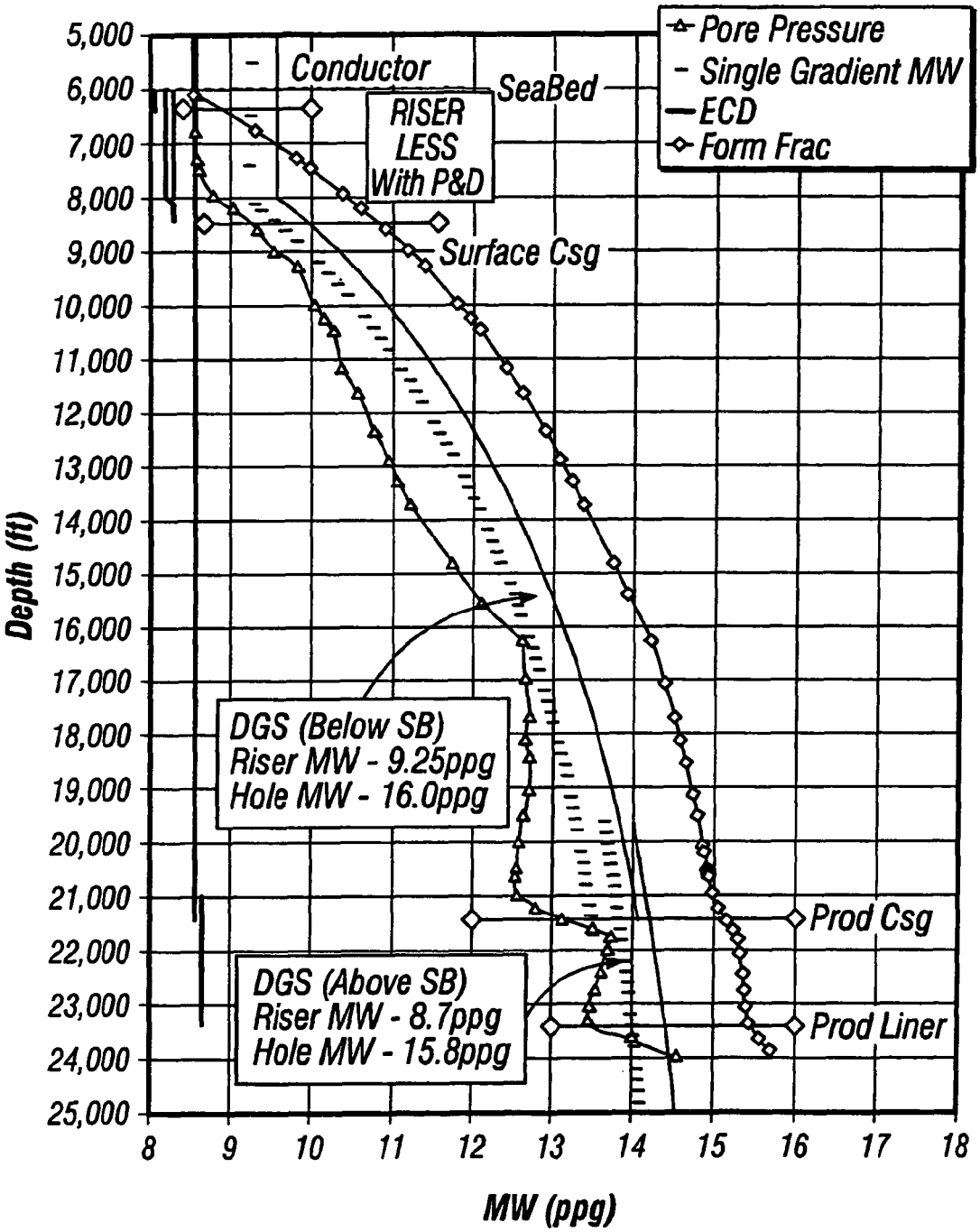
FIG. 8 is a graph showing depth versus down hole pressures and illustrates the advantages obtained using multiple density muds injected below the seabed versus a single gradient mud.
Figure 11:
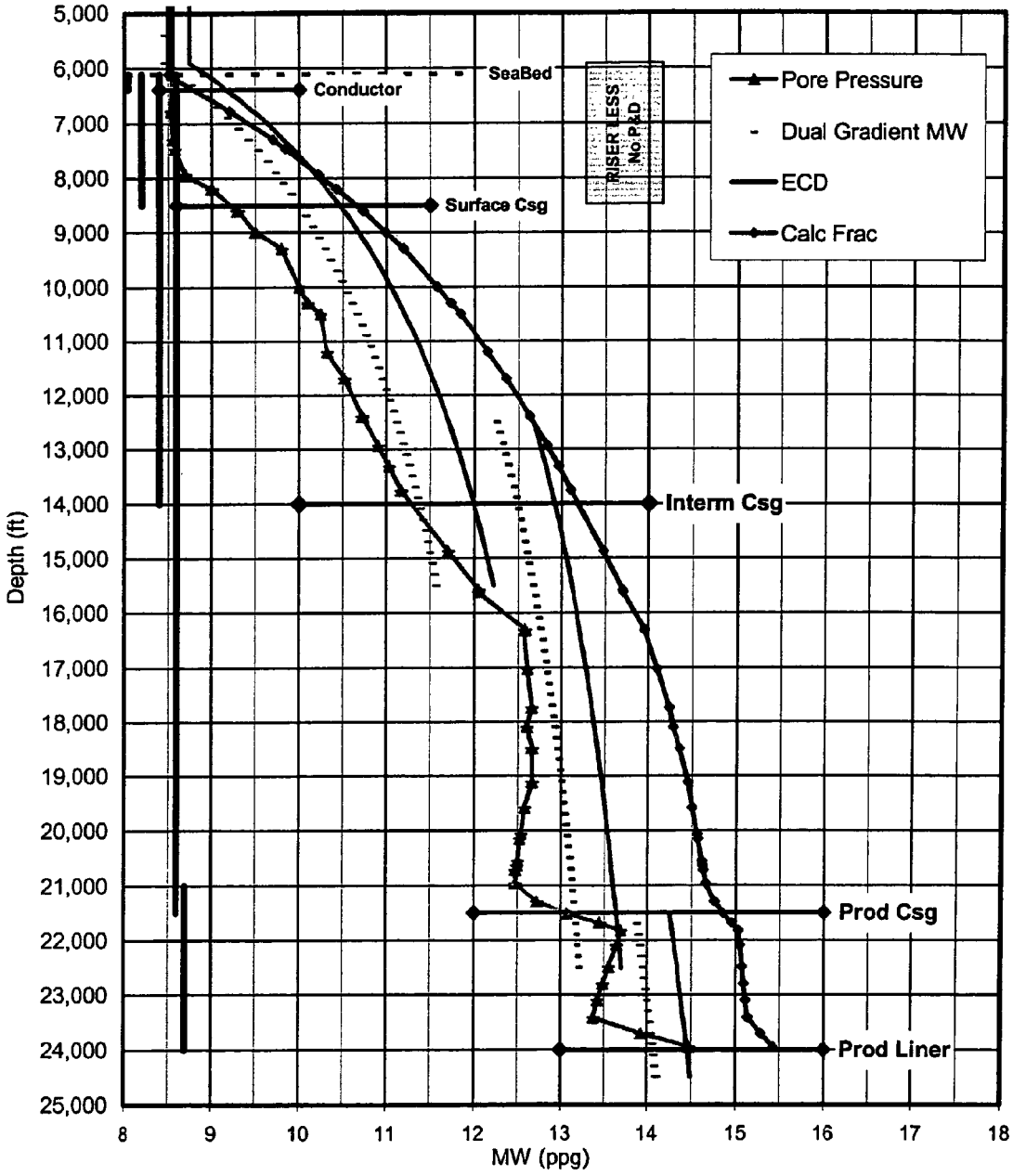
FIG. 11 is a graph showing depth versus downhole pressures and illustrates the advantages obtained using multiple density muds injected at the seabed versus a single gradient mud in drilling with casing operations.
Figure 12:
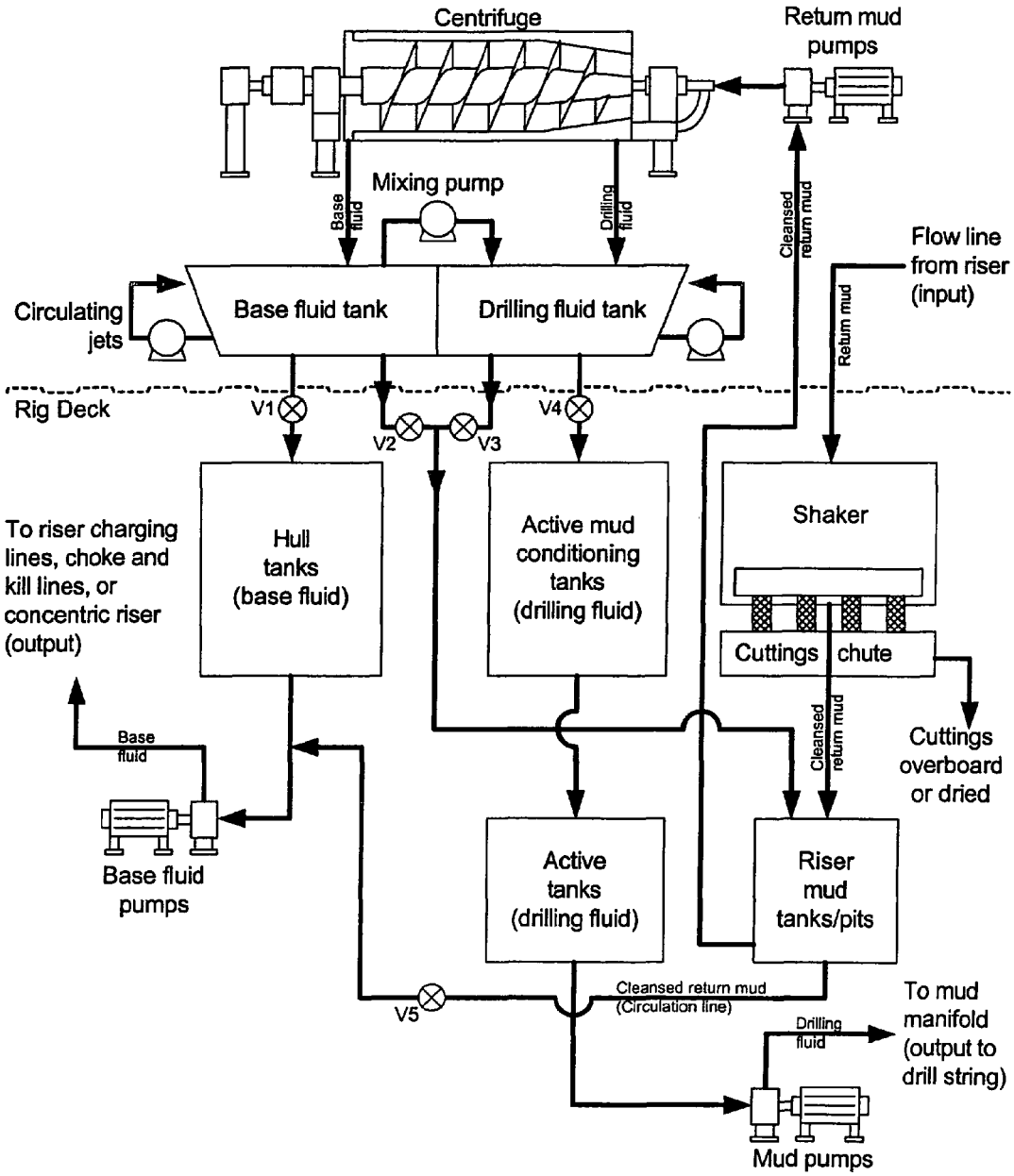
FIG. 12 is a diagram of the drilling mud treatment system in accordance with the present invention for stripping the base fluid from the drilling mud at or above the seabed.
Figure 13:
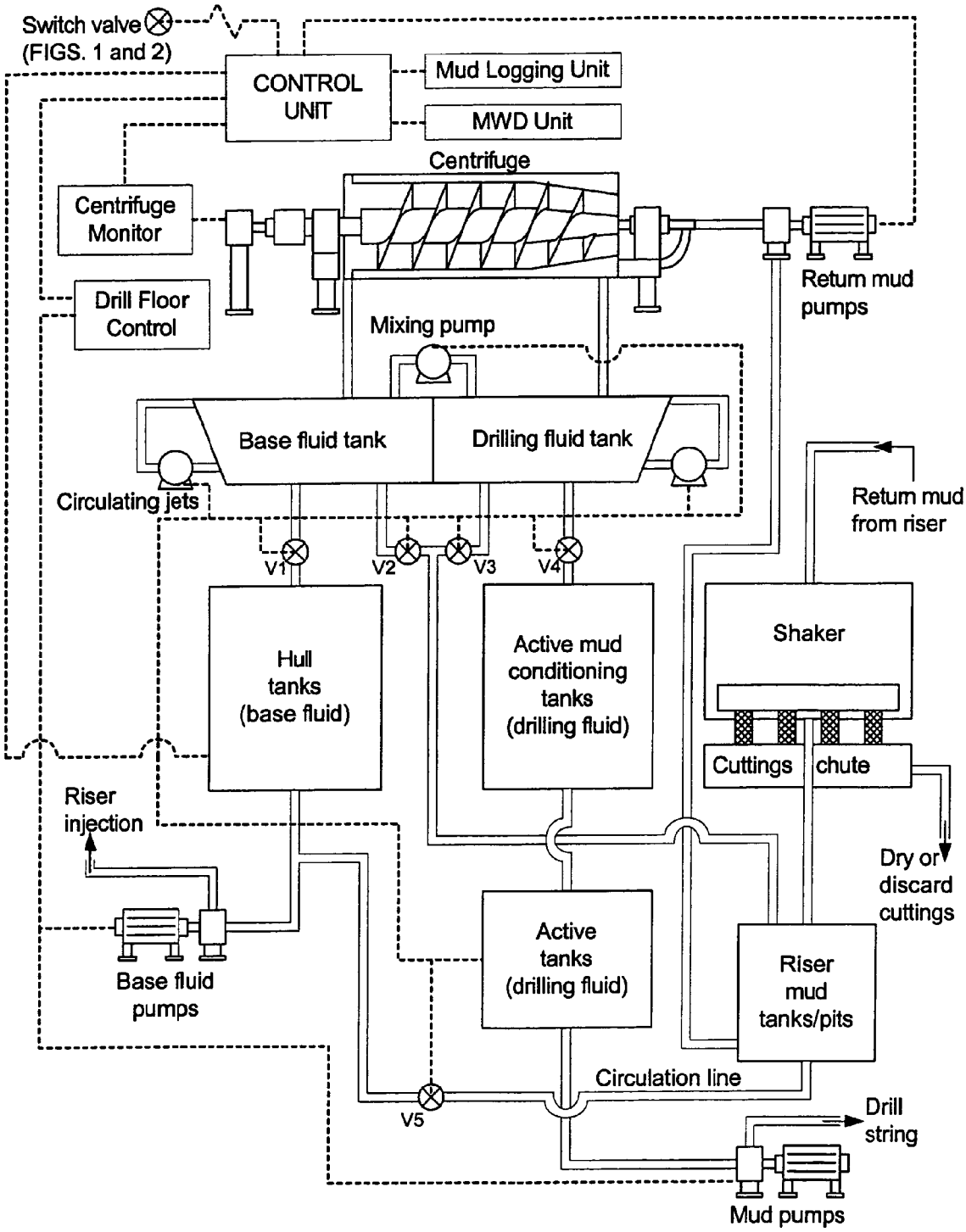
FIG. 13 is a diagram of control system for monitoring and manipulating variables for the drilling mud treatment system of the present invention.
Figure 14:
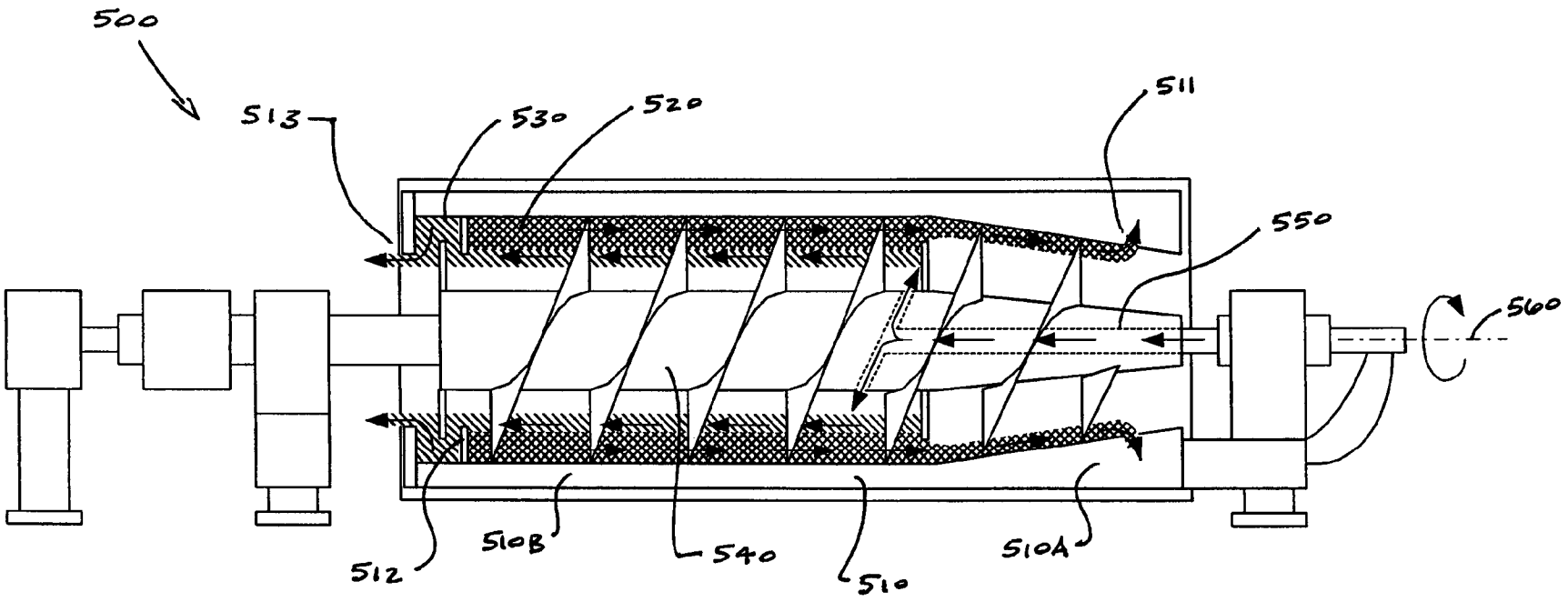
FIG. 14 is an enlarged elevation view of a conventional solid bowl centrifuge as used in the treatment system of the present invention to separate the low-density material from the high-density material in the return mud.

An example of the advantages achieved using the dual density mud method of the present invention in conventional well drilling operations is shown in the graphs of FIGS. 6-8. Likewise, FIG. 11 illustrates the advantages achieved using the dual density mud method of the present invention in non-conventional—specifically, drilling with casing—operations. The graph of FIG. 6 depicts casing setting depths with single gradient mud; the graph of FIG. 7 depicts casing setting depths with dual gradient mud inserted at the seabed; the graph of FIG. 8 depicts casing setting depths with dual gradient mud inserted below the seabed; the graph of FIG. 11 depicts casing setting depths with dual gradient mud inserted at or near the seabed using DWC methodology. The graphs of FIGS. 6-8 and 11 demonstrate the advantages of using a dual gradient mud over a single gradient mud. The vertical axis of each graph represents depth and shows the seabed or sea floor at approximately 6,000 feet. The horizontal axis represents mud weight in pounds per gallon or "PPG". The solid line represents the "equivalent circulating density" (ECD) in PPG. The diamonds represents formation frac pressure. The triangles represent pore pressure. The bold vertical lines on the far left side of the graph depict the number of casings required to drill the well with the corresponding drilling mud at a well depth of approximately 23,500 feet. With respect to FIG. 6, when using a single gradient mud, a total of six casings are required to reach total depth (conductor, surface casing, intermediate liner, intermediate casing, production casing, and production liner). With respect to FIG. 7, when using a dual gradient mud inserted at or just above the seabed, a total of five casings are required to reach total depth (conductor, surface casing, intermediate casing, production casing, and production liner). With respect to FIG. 8, when using a dual gradient mud inserted approximately 2,000 feet below the seabed, a total of four casings are required to reach total depth (conductor, surface casing, production casing, and production liner). With respect to FIG. 11, when using a dual gradient mud inserted at or near the seabed, a total of five casings are required to reach total depth (conductor, surface casing, interim casing, production casing, and production liner). By reducing the number of casings run and installed downhole, it will be appreciated by one of skill in the art that the number of rig days and the total well cost will be decreased.

In another embodiment of the present invention, the mud recirculation system includes a treatment system located at the surface for: (1) receiving the return combined mud, (2) removing the drill cuttings from the mud, and (3) stripping barite from the drilling fluid. It is intended that this treatment system may be used with both convention drill bit drilling operations and in DWC operations. As used in this description, the term "mud" refers to any type of fluid, such as mud, seawater or whatever fluid is selected for a particular operation that is combined with a weight material, such as barite, to comprise a drilling fluid. This drilling fluid is pumped into the well in a manner well known in the art, such as via the drill string, circulated in the wellbore in order to pick-up drill cuttings and retrieved from the wellbore via risers. At the surface, the recovered drilling fluid is then processed for recirculation utilizing the process set forth herein.

With respect to FIG. 7, the treatment system of the present invention includes: (1) a shaker device for separating drill cuttings from the return mud, (2) a set of riser fluid tanks or pits for receiving the cleansed return mud from the shaker, (3) a separation skid located on the deck of the drilling rig—which comprises a centrifuge, a set of return mud pumps, a base fluid collection tank and a drilling fluid collection tank—for receiving the cleansed return mud and separating the mud into a drilling fluid component and a base fluid component, (4) a set of hull tanks for storing the stripped base fluid component, (5) a set of base fluid pumps for re-inserting the base fluid into the riser stream via the charging line, (6) a set of conditioning tanks for adding mud conditioning agents to the drilling fluid component, (7) a set of active tanks for storing the drilling fluid component, and (8) a set of mud pumps to pump the drilling fluid into the wellbore via the drill string.

In operation, the return mud is first pumped from the riser into the shaker device having an inlet for receiving the return mud via a flow line connecting the shaker inlet to the riser. Upon receiving the return mud, the shaker device separates the drill cuttings from the return mud producing a cleansed return mud. The cleansed return mud flows out of the shaker device via a first outlet, and the cuttings are collected in a chute and bourn out of the shaker device via a second outlet. Depending on environmental constraints, the cuttings may be dried and stored for eventual off-rig disposal or discarded overboard.

The cleansed return mud exits the shaker device and enters the set of riser mud tanks/pits via a first inlet. The set of riser mud tanks/pits holds the cleansed return mud until it is ready to be separated into its basic components—drilling fluid and base fluid. The riser mud tanks/pits include a first outlet through which the cleansed mud is pumped out.

The cleansed return mud is pumped out of the set of riser mud tanks/pits and into the centrifuge device of the separation skid by a set of return mud pumps. While the preferred embodiment includes a set of six return mud pumps, it is intended that the number of return mud pumps used may vary depending upon on drilling constraints and requirements. The separation skid includes the set of return mud pumps, the centrifuge device, a base fluid collection tank for gathering the lighter base fluid, and a drilling fluid collection tank to gather the heavier drilling mud.

As shown in FIG. 9, the centrifuge device 500 includes: (1) a bowl 510 having a tapered end 510A with an outlet port 511 for collecting the high-density fluid 520 and a non-tapered end 510B having an adjustable weir plate 512 and an outlet port 513 for collecting the low-density fluid 530, (2) a helical (or "screw") conveyor 540 for pushing the heavier density fluid 520 to the tapered end 510A of the bowl 510 and out of the outlet port 511, and (3) a feed tube 550 for inserting the return mud into the bowl 510. The conveyor 540 rotates along a horizontal axis of rotation 560 at a first selected rate and the bowl 510 rotates along the same axis at a second rate which is relative to but generally faster than the rotation rate of the conveyor.

The cleansed return mud enters the rotating bowl 510 of the centrifuge device 500 via the feed tube 550 and is separated into layers 520, 530 of varying density by centrifugal forces such that the high-density layer 520 (i.e., the drilling fluid with density Mi) is located radially outward relative to the axis of rotation 560 and the low-density layer 530 (i.e., the base fluid with density Mb) is located radially inward relative to the high-density layer. The weir plate 512 of the bowl is set at a selected depth (or "weir depth") such that the drilling fluid 520 cannot pass over the weir and instead is pushed to the tapered end 510A of the bowl 510 and through the outlet port 511 by the rotating conveyor 540. The base fluid 530 flows over the weir plate 512 and through the outlet 513 of the non-tapered end 510B of the bowl 510. In this way, the return mud is separated into its two components: the base fluid with density Mb and the drilling fluid with density Mi.

The base fluid is collected in the base fluid collection tank and the drilling fluid is collected in the drilling fluid collection tank. In a preferred embodiment of the present invention, both the base fluid collection tank and the drilling fluid collection tank include a set of circulating jets to circulate the fluid inside the tanks to prevent settling of solids. Also, in a preferred embodiment of the present invention, the separation skid includes a mixing pump which allows a predetermined volume of base fluid from the base fluid collection tank to be added to the drilling fluid collection tank to dilute and lower the density of the drilling fluid.

The base fluid collection tank includes a first outlet for moving the base fluid into the set of hull tanks and a second outlet for moving the base fluid back into the set of riser mud tanks/pits if further separation is required. If valve V1 is open and valve V2 is closed, the base fluid will feed into the set of hull tanks for storage. If valve V1 is closed and valve V2 is open, the base fluid will feed back into the set of riser fluid tanks/pits to be run back through the centrifuge device.

Each of the hull tanks includes an inlet for receiving the base fluid and an outlet. When required, the base fluid can be pumped from the set of hull tanks through the outlet and re-injected into the riser mud at a location at or below the seabed via the riser charging lines using the set of base fluid pumps. While the separation system allows the base fluid to be recovered from the return combination fluid and recirculated into the riser, it should be noted that the due to some contamination (e.g., fine solids and viscosifiers) the recycled base fluid will have a slightly greater density than the original base fluid initially inserted. For example, if a 6.5 PPG base fluid is inserted into the return mud stream having a density of 12.5 PPG to form a combination fluid having a density of 8.6 PPG, then it is expected that once stripped from the combination fluid, the recovered base fluid may have a density of approximately 7.0 PPG.

The drilling fluid collection tank includes a first outlet for moving the drilling fluid into the set of conditioning tanks and a second outlet for moving the drilling fluid back into the set of riser mud tanks/pits if further separation is required. If valve V3 is open and valve V4 is closed, the drilling fluid will feed into the set of conditioning tanks. If valve V3 is closed and valve V4 is open, the drilling fluid will feed back into the set of riser fluid tanks/pits to be run back through the centrifuge device.

Each of the active mud conditioning tanks includes an inlet for receiving the drilling fluid component of the return mud and an outlet for the conditioned drilling fluid to flow to the set of active tanks. In the set of conditioning tanks, mud conditioning agents may be added to the drilling fluid. Mud conditioning agents (or "thinners") are generally added to the drilling fluid to reduce flow resistance and gel development in clay-water muds. These agents may include, but are not limited to, plant tannins, polyphosphates, lignitic materials, and lignosulphates. Also, these mud conditioning agents may be added to the drilling fluid for other functions including, but not limited to, reducing filtration and cake thickness, countering the effects of salt, minimizing the effect of water on the formations drilled, emulsifying oil in water, and stabilizing mud properties at elevated temperatures.

Once conditioned, the drilling fluid is fed into a set of active tanks for storage. Each of the active tanks includes an inlet for receiving the drilling fluid and an outlet. When required, the drilling fluid can be pumped from the set of active tanks through the outlet and into the drill string via the mud manifold using a set of mud pumps.

While the treatment system of the present invention is described with respect to stripping a low-density base fluid from the return mud to achieve the high-density drilling fluid in a dual gradient system, it is intended that treatment system can be used to strip any material—fluid or solid—having a density different than the density of the drilling fluid from the return mud. For example, drilling mud in a single density drilling fluid system or "total mud system" comprising a base fluid with barite can be separated into a base fluid component and a barite component using the treatment system of the present invention. In one embodiment of the invention, barite is separated from the drilling fluid that has been recovered and substantially cleansed of drill cuttings. A centrifuge at the drilling rig separates the drilling fluid into two components, namely a lighter density component and a heavier density component. The lighter density component consists substantially of drilling mud, while the heavier density component consists of substantially barite. Those skilled in the art will appreciate that neither component will be completely free of the other component, but only substantially free of the other component such that the separate components can be utilized for their primary functions. Preferably, the centrifuge can be controlled to adjust the amount of fluid, i.e., mud, that remains in combination with the barite, such as for example, leaving 10%, 20% or 30% fluid in combination with the barite. In other words, the density of the heavier density barite component can be increased by removing more of the lighter fluid mud. Thus, the centrifuge process itself can be utilized to control the density of the barite component. This permits the preparation of several different weights of barite solutions, each of which can be locally stored and subsequently utilized as needed in the recirculation operations. Likewise, the drilling fluid can be stored on the rig and recirculated. This is preferable to the prior art in which the recovered combination drilling fluid is pumped onto barges and shipped to shore for cleaning and disposal. The method as described herein minimizes transportation costs associated with transporting barite and mud to the rig and transporting the recovered combination fluid from the rig. Likewise, disposal costs are minimized and barite costs are reduced since the barite is being recovered and reused. Another benefit of the above-described process is that the pumpability of the barite component can be adjusted and controlled as desired. This is particularly desirable since the barite component is being managed and stored on site at the drilling rig.

In a total mud system, each section of the well is drilled using a drilling mud having a single, constant density. However, as deeper sections of the well are drilled, it is required to use a mud having a density greater than that required to drill the shallower sections. More specifically, the shallower sections of the well may be drilled using a drilling mud having a density of 10 PPG, while the deeper sections of the well may require a drilling mud having a density of 12 PPG. In previous operations, once the shallower sections of the well were drilled with 10 PPG mud, the mud would be shipped from the drilling rig to a location onshore to be treated with barite to form a denser 12 PPG mud. After treatment, the mud would be shipped back offshore to the drilling rig for use in drilling the deeper sections of the well. The treatment system of the present invention, however, may be used to treat the 10 PPG density mud to obtain the 12 PPG density mud without having the delay and expense of sending the mud to and from a land-based treatment facility. This may be accomplished by using the separation unit to draw off and store the base fluid from the 10 PPG mud, thus increasing the concentration of barite in the mud until a 12 PPG mud is obtained. The deeper sections of the well can then be drilled using the 12 PPG mud. Finally, when the well is complete and a new well is begun, the base fluid can be combined with the 12 PPG mud to reacquire the 10 PPG mud for drilling the shallower sections of the new well. In this way, valuable components—both base fluid and barite—of a single gradient mud may be stored and combined at a location on the rig to efficiently create a mud tailored to the drilling requirement of a particular section of the well.

In still another embodiment of the present invention, the treatment system includes a circulation line for boosting the riser fluid with drilling fluid of the same density in order to circulate cuttings out the riser. As shown in FIG. 7, when the valve V5 is open, cleansed riser return mud can be pumped from the set of riser mud tanks or pits and injected into the riser stream at a location at or below the seabed. This is performed when circulation downhole below the seabed has stopped thru the drill string and no dilution is required.

In yet another embodiment of the present invention, the mud recirculation system includes a multi-purpose software-driven control unit for manipulating drilling fluid systems and displaying drilling and drilling fluid data. With respect to FIG. 8, the control unit is used for manipulating system devices such as: (1) opening and closing the switch valve 101 (see also FIGS. 1 and 2), the control valves V1, V2, V3, and V4, and the circulation line valve V5, (2) activating, deactivating, and controlling the rotation speed of the set of mud pumps, the set of return mud pumps, and the set of base fluid pumps, (3) activating and deactivating the circulation jets, and (4) activating and deactivating the mixing pump. Also, the control unit may be used to adjust centrifuge variables including feed rate, bowl rotation speed, conveyor speed, and weir depth in order to manipulate the heavy fluid discharge.

Furthermore, the control unit is used for receiving and displaying key drilling and drilling fluid data such as: (1) the level in the set of hull tanks and set of active tanks, (2) readings from a measurement-while-drilling (or "MWD") instrument, (3) readings from a pressure-while-drilling (or "PWD") instrument, and (4) mud logging data.

A MWD instrument is used to measure formation properties (e.g., resistivity, natural gamma ray, porosity), wellbore geometry (e.g., inclination and azimuth), drilling system orientation (e.g., toolface), and mechanical properties of the drilling process. A MWD instrument provides real-time data to maintain directional drilling control.

A PWD instrument is used to measure the differential well fluid pressure in the annulus between the instrument and the wellbore while drilling mud is being circulated in the wellbore. A PWD unit provides real-time data at the surface of the well indicative of the pressure drop across the bottom hole assembly for monitoring motor and MWD performance.

Figure 15:
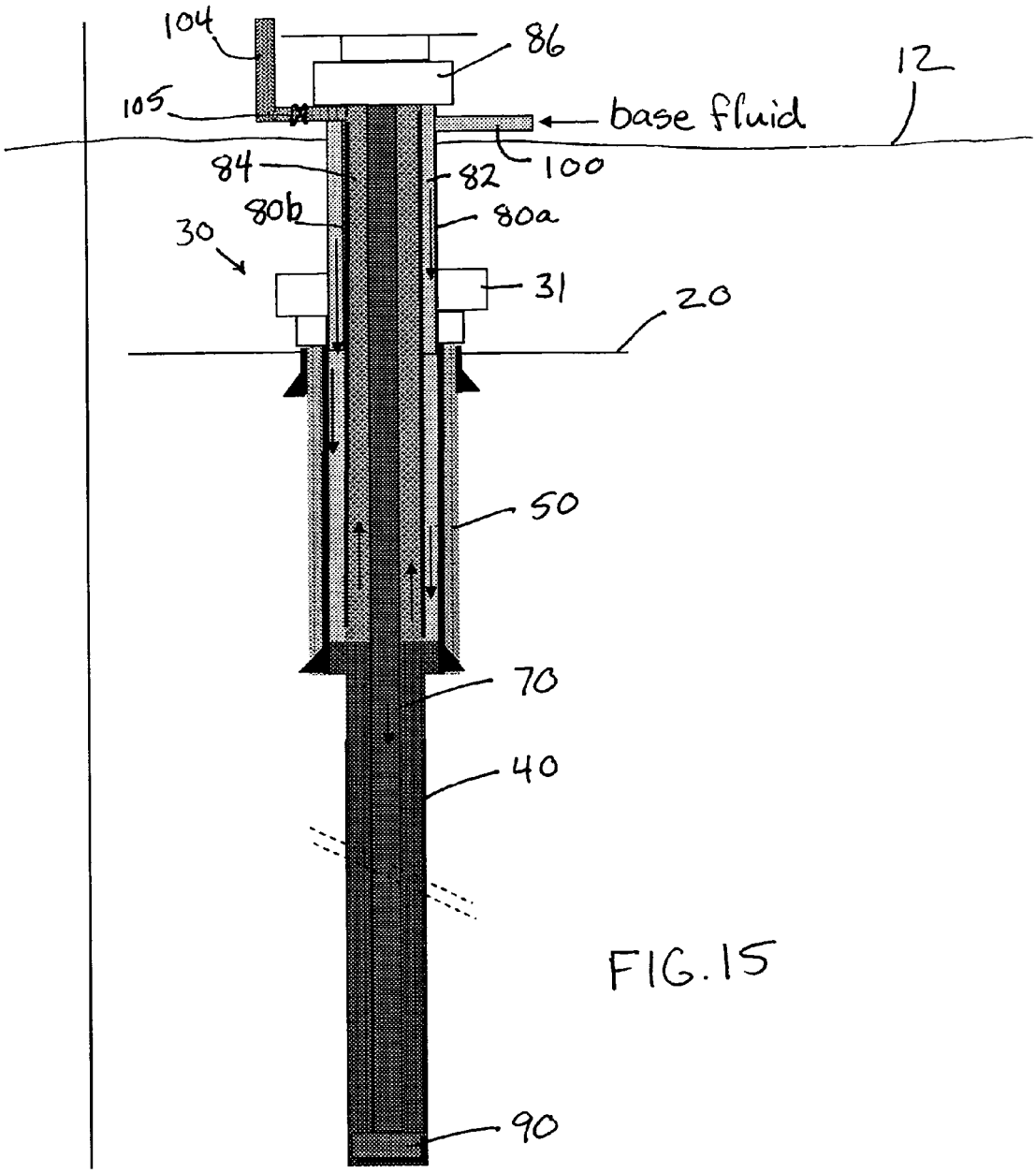
FIG. 15 is a schematic of an offshore drilling system having concentric risers utilized to inject a base fluid into drilling mud and recover diluted mud for processing at the drilling rig.

Still yet another preferred embodiment of the invention is shown in FIG. 15. Again, a platform 10 is provided from which drilling operations are performed. While the platform may be land based and the apparatus and method of the invention used in land-based drilling operations, for purposes of the description, the system is described in a deep-water environment. With this in mind, platform 10 may be any type of drilling platform, such as for example only, an anchored floating platform or a drill ship or a semi-submersible drilling unit located at the ocean surface 12. A series of concentric strings runs from the platform 10 to the sea floor or seabed 20 and into a stack 30. The stack 30 is positioned above a wellbore 40 and may include control components, such as for example only, one or more blowout preventers or BOP's 31. In this case, BOP 31 is shown positioned at the wellhead. The concentric strings include casing 50, a drill string 70, a first riser 80*a* and a second riser 80*b*. Defined between first riser 80*a* and second riser 80*b* is a first annulus 82. Defined between second riser 80*b* and drill string 70 is a second annulus 84. A second BOP 86 is provided along the concentric string. While second BOP 86 may be provided anywhere along such concentric string, in the illustration, second BOP 86 is disposed adjacent surface 12 at platform 10. A drill bit 90 is mounted on the end of the drill string 70. A riser charging line (or booster line) 100 is provided in one of the risers 80*a*, 80*b* so as to be in fluid communication with one of the annuli 82, 84. In the illustration, line 100 is attached to first riser 80*a* and is in fluid communication with first annulus 82. Charging line 100 is used to insert a base fluid into annulus 82, which fluid is caused to flow down annulus 82 to mix with the upwardly returning drilling mud, thereby forming a combination fluid of drilling mud and base fluid. The actual point of mixing of the drilling mud and the base fluid may be at a location at, above or below the seabed 20. The base fluid may flow from ports provided in riser 80*a* or out the downhole end of riser 80*a*. It is the mixing of the base fluid with the drilling mud in order to control wellbore and riser pressure differentials (as described above) that forms a part of the inventive concept. In this regard, the density of the base fluid is different from the density of the drilling mud. In one preferred embodiment, the density of the base fluid is less than the density of the drilling mud while in another preferred embodiment, the density of the base fluid is greater than the density of the drilling mud. In any event, the combination fluid rises back to the surface through riser 80*b* via second annulus 84. A discharge line 104 is in fluid communication with the return annulus, which in this case is second annulus 84. Discharge line 104 may include a choke 105, which is preferably an adjustable choke, to maintain backpressure in second annulus 84 during circulation. Those skilled in the art will appreciate that the particular annulus and riser used to deliver base fluid for mixing with drilling mud and the particular annulus and riser through which the returning combination fluid flows may be reversed. In such case, the base fluid would be injected via line 104 into second annulus 84 and caused to flow down second annulus 84. The combination fluid would flow back up to return via first annulus 82 for recovery via line 100. Once recovered, the combination fluid can thereafter be separated at or adjacent platform 10 as previously described herein.

In the preferred embodiment of FIG. 15, the pressure differential within the return combination fluid riser and wellbore 40 can be controlled by either the base fluid injected for mixing with the drilling mud, by utilizing second BOP 86 or by a combination of the two.

Mud logging is used to gather data from a mud logging unit which records and analyzes drilling mud data as the drilling mud returns from the wellbore. Particularly, a mud logging unit is used for analyzing the return mud for entrained oil and gas, and for examining drill cuttings for reservoir quality and formation identification.

While certain features and embodiments have been described in detail herein, it should be understood that the invention includes all of the modifications and enhancements within the scope and spirit of the following claims.

In the afore specification and appended claims: (1) the term "tubular member" is intended to embrace "any tubular good used in well drilling operations" including, but not limited to, "a casing", "a subsea casing", "a surface casing", "a conductor casing", "an intermediate liner", "an intermediate casing", "a production casing", "a production liner", "a casing liner", or "a riser"; (2) the term "drill tube" is intended to embrace "any drilling member used to transport a drilling fluid from the surface to the wellbore" including, but not limited to, "a drill pipe", "a string of drill pipes", or "a drill string"; (3) the terms "connected", "connecting", "connection", and "operatively connected" are intended to embrace "in direct connection with" or "in connection with via another element"; (4) the term "set" is intended to embrace "one" or "more than one"; (5) the term "charging line" is intended to embrace any auxiliary riser line, including but not limited to "riser charging line", "booster line", "choke line", "kill line", or "a high-pressure marine concentric riser"; (6) the term "system variables" is intended to embrace "the feed rate, the rotation speed of the set of mud pumps, the rotation speed of the set of return mud pumps, the rotation speed of the set of base fluid pumps, the bowl rotation speed of the centrifuge, the conveyor speed of the centrifuge, and/or the weir depth of the centrifuge"; (7) the term "drilling and drilling fluid data" is intended to embrace "the contained volume in the set of hull tanks, the contained volume in the set of active tanks, the readings from a MWD instrument, the readings from a PWD instrument, and mud logging data"; and (8) the term "tanks" is intended to embrace "tanks" or "pits".

What is claimed is:

1. A system in well drilling operations for controlling the density of a drilling fluid in a wellbore extending into the earth from a top end adjacent the surface, said system comprising:

(a) a first tubular member having a top end and a bottom end, the top end of said first tubular member extending adjacent to or above the top end of the wellbore, the bottom end of said first tubular member being located in the wellbore, said first tubular member having a predetermined outer diameter;

(b) a second tubular member having a top end and a bottom end, the top end of said second tubular member being located adjacent to or above the top end of the wellbore and the bottom end of said second tubular member being located in the wellbore, said second tubular member having a predetermined inner diameter which is greater than the outer diameter of the first tubular member, said second tubular member being arranged such that the first tubular member is disposed within at least a portion of the second tubular member to define an annular space between the outer diameter of the first tubular member and the inner diameter of the second tubular member;

(c) a drilling device connected to the bottom end of the first tubular member;

(d) a drilling fluid having a predetermined density disposed in said first tubular member, wherein said drilling fluid comprises a weighting agent;

(e) a base fluid having a predetermined density different than the predetermined density of the drilling fluid;

(f) a combination fluid comprised of the base fluid and the drilling fluid; and (g) a centrifuge, said centrifuge having a longitudinal axis with a helical conveyor disposed along said axis, an adjustable weir plate disposed around said axis, a first fluid outlet; and a second fluid outlet;

wherein the weir plate and conveyor are disposed to direct a substantial portion of said weighting agent and a portion of said combination fluid together through one of said fluid outlets.

2. The system of claim 1, wherein said centrifuge further comprises a housing around said conveyor and two weir plates, wherein one weir plate is disposed at a first end of said conveyor and a second weir plate is disposed at a second end of said conveyor, wherein one weir plate is mounted on said housing and the other weir plate is mounted on said conveyor, wherein said first weir plate is defined by an outer edge and said first weir plate is disposed in said centrifuge such that fluid passes over the outer edge of the first weir plate, and wherein said second weir plate is defined by an inner edge and said weir plate is disposed in said centrifuge such that fluid passes over the inner edge of the second weir plate.

3. The system of claim 1, further comprising:

(a) a drilling rig;

(b) a third tubular member having an upper end adjacent the drilling rig and a lower end in fluid communication with the wellbore.

4. The system of claim 3, wherein said base fluid is disposed in said third tubular member for delivery to said wellbore and said combination fluid is disposed in said second tubular member.

5. The system of claim 1, wherein said centrifuge comprises two weir plates.

6. The system of claim 5, wherein one weir plate is disposed at a first end of said conveyor and a second weir plate is disposed at a second end of said conveyor and wherein one of said fluid outlets is disposed at a first end of said conveyor and the other fluid outlet is disposed at the second end of said conveyor.

7. The system of claim 5, wherein said centrifuge further comprises a housing around said conveyor, and wherein one weir plate is mounted on said housing and the other weir plate is mounted on said conveyor.

8. The system of claim 5, wherein said first weir plate is defined by an outer edge and said first weir plate is disposed in said centrifuge such that fluid passes over the outer edge of the first weir plate, and wherein said second weir plate is defined by an inner edge and said weir plate is disposed in said centrifuge such that fluid passes over the inner edge of the second weir plate.

9. The system of claim 1 further comprising a third tubular member in which said combination fluid is disposed.

10. The system of claim 9, wherein the third tubular member is a riser and the second tubular member is casing.

11. The system of claim 1, further comprising a back pressure valve disposed in the first tubular member adjacent the bottom end of the first tubular member.

12. A method employed in well drilling operations for varying the density of fluid in a wellbore operation, wherein a first tubular member is run through a second tubular member, said first tubular member used to drill a wellbore, said method comprising the steps of:

(a) introducing a first fluid having a first predetermined density into the wellbore via the first tubular member;

(b) generating drill cuttings from said wellbore utilizing said first tubular member;

(d) introducing into the wellbore a second fluid having a second predetermined different than the first predetermined density;

(e) combining said first fluid and said second fluid in the wellbore to produce a combination fluid, wherein said combination fluid rises towards the surface along with the drill cuttings;

(d) removing the drill cuttings from the combination fluid;

(e) introducing the combination fluid into a centrifuge, said combination fluid comprising a weighting agent;

(f) providing a weir plate in said centrifuge to impede flow of at least one fluid therein;

(g) utilizing said centrifuge to separate the combination fluid into a first fluid component and a second fluid component, at least one of said fluid components comprising said weighting agent;

(h) removing a substantial portion of the weighting agent from the centrifuge utilizing at least one fluid component; and (i) maintaining said first fluid component and second fluid components as fluids for reintroduction back into the drilling operations.

13. The method of claim 12 further comprising the step of adjusting the makeup of at least one fluid component by adjusting the height of the weir plate.

14. The method of claim 12 further comprising the steps providing a second weir plate in said centrifuge to impede flow of at least one fluid therein and adjusting the makeup of at least one fluid component by adjusting the height of the second weir plate.

15. The method of claim 12 further comprising the step of reintroducing said first fluid component into the wellbore as the first fluid and introducing said second fluid component into the wellbore as said second fluid without mixing said fluids with additional weighting mud.

16. A system in well drilling operations for controlling the density of a drilling fluid in a wellbore extending into the earth from a top end adjacent the surface, said system comprising:

a drilling rig;

a first tubular member having a top end and a bottom end, the top end of said first tubular member adjacent said drilling rig, the bottom end of said first tubular member being located in the wellbore, said first tubular member having a predetermined outer diameter;

a second tubular member having a top end and a bottom end, the top end of said second tubular member being located adjacent the drilling rig and the bottom end of said second tubular member extending to at least the top end of the wellbore, said second tubular member having a predetermined inner diameter which is greater than the outer diameter of the first tubular member, said second tubular member being arranged such that the first tubular member is disposed within at least a portion of the second tubular member to define a first annular space between the outer diameter of the first tubular member and the inner diameter of the second tubular member;

a third tubular member having a top end and a bottom end, the top end of said third tubular member being located adjacent the rig and the bottom end of said third tubular member extending to at least the top end of the wellbore so as to be in fluid communication with said wellbore;

a drilling device connected to the bottom end of the first tubular member;

a drilling fluid having a predetermined density disposed in said first tubular member wherein said drilling fluid comprises a weighting agent;

a base fluid having a predetermined density different than the predetermined density of the drilling fluid wherein the base fluid is disposed in one of the second or third tubular members; and a combination fluid comprised of the base fluid and the drilling fluid, wherein the combination fluid is disposed in one of the second or third tubular members not occupied by the base fluid; and a centrifuge having a longitudinal axis with a helical conveyor disposed along said axis and an adjustable weir plate disposed around said axis, said centrifuge further having a first fluid outlet and a second fluid outlet, wherein the weir plate and conveyor are disposed to direct a substantial portion of said weighting agent and a portion of said combination fluid together through one of said fluid outlets, wherein the tubular member having the combination fluid is in fluid communication with said centrifuge.

17. The system of claim 16, further comprising a first fluid tank in fluid communication with the first fluid outlet and a second fluid tank in fluid communication with said second fluid outlet of said centrifuge.

18. The system of claim 16, further comprising a shaker in fluid communication with said tubular member in which the combination fluid is disposed.

19. The system of claim 16, further comprising a first fluid storage tank and a second fluid storage tank, wherein the first fluid storage tank is disposed inline between said first fluid outlet and said first tubular member and said second fluid storage tank is disposed in-line between said second fluid outlet and said tubular member in which the base fluid is disposed.

20. The system of claim 16, wherein said centrifuge comprises two weir plates.

21. The system of claim 20, wherein one weir plate is disposed at a first end of said conveyor and a second weir plate is disposed at a second end of said conveyor.

22. The system of claim 20, wherein said centrifuge further comprises a housing around said conveyor, and wherein one weir plate is mounted on said housing and the other weir plate is mounted on said conveyor.

23. The system of claim 20, wherein said first weir plate is defined by an outer edge and said first weir plate is disposed in said centrifuge such that fluid passes over the outer edge of the first weir plate, and wherein said second weir plate is defined by an inner edge and said weir plate is disposed in said centrifuge such that fluid passes over the inner edge of the second weir plate.

24. A method for conditioning mud in a drilling system, said method comprising the steps of:

introducing into a wellbore a weighted mud having a predetermined density and comprising a weighting agent;

introducing into the wellbore a base fluid having a predetermined density different than the predetermined density of the weighted mud;

recovering from the wellbore a combination fluid comprising weighted mud, drill cuttings and base fluid;

removing the drill cuttings from the combination fluid;

after the drill cuttings have been removed, utilizing a centrifuge having an adjustable weir plate to separate the resulting combination fluid into only two outputs, a first fluid portion and a second fluid portion, wherein the weighting agent is carried by at least one of said fluid portions and wherein the first fluid portion and the second fluid portion have different densities;

removing a substantial portion of said weighting agent from said centrifuge by removing said first and second fluid portions; and wherein said densities are achieved by adjusting the weir plate.

25. The method of claim 24, further comprising the steps of storing said first fluid portion and said second fluid portion adjacent the drilling rig of the drilling system;

reintroducing into the wellbore said first fluid portion as said weighted mud; and reintroducing into the wellbore said second fluid portion as said base fluid.

* * * * *